US010411364B2

(12) United States Patent
Anguera Pros et al.

(10) Patent No.: US 10,411,364 B2
(45) Date of Patent: Sep. 10, 2019

(54) DISTRIBUTED ANTENNA SYSTEM ROBUST TO HUMAN BODY LOADING EFFECTS

(71) Applicant: Fractus Antennas, S.L., Sant Cugat del Vallès, Barcelona (ES)

(72) Inventors: Jaume Anguera Pros, Vinaros (ES); Carles Puente Baliarda, Sant Cugat del Valles (ES)

(73) Assignee: Fractus Antennas, S.L., Sant Cugat del Valles, Barcelona (ES)

( * ) Notice: Subject to any disclaimer, the term of this patent is extended or adjusted under 35 U.S.C. 154(b) by 0 days.

(21) Appl. No.: 16/027,891

(22) Filed: Jul. 5, 2018

(65) Prior Publication Data

US 2019/0020125 A1 Jan. 17, 2019

Related U.S. Application Data

(63) Continuation of application No. 14/635,568, filed on Mar. 2, 2015, now Pat. No. 10,033,114, which is a
(Continued)

(30) Foreign Application Priority Data

Jun. 8, 2006 (EP) ..... 06115119

(51) Int. Cl.
*H01Q 21/30* (2006.01)
*H01Q 1/24* (2006.01)
(Continued)

(52) U.S. Cl.
CPC ..... *H01Q 21/30* (2013.01); *H01Q 1/245* (2013.01); *H01Q 3/36* (2013.01);
(Continued)

(58) Field of Classification Search
CPC ..... H01Q 1/243
(Continued)

(56) References Cited

U.S. PATENT DOCUMENTS 4,316,194 A 2/1982 De Santis
4,633,258 A 12/1986 Mok
(Continued)

FOREIGN PATENT DOCUMENTS

EP 0571124 11/1993
EP 0984508 A2 3/2000
(Continued)

OTHER PUBLICATIONS

Balanis, C.A., Antenna Theory: Analysis and design, 1997, pp. 772-774, John Wiley & Sons, New York.
(Continued)

*Primary Examiner* — Dameon E Levi
*Assistant Examiner* — Hasan Z Islam
(74) *Attorney, Agent, or Firm* — Edell, Shapiro & Finnan, LLC

(57) ABSTRACT

A wireless handheld device comprises an internal antenna system that operates in first and second non-overlapping frequency bands with respective bandwidths. The antenna system includes: a ground plane; first and second antenna elements connected to a common input/output port, wherein a bandwidth of each of the antenna elements is less than at least one of the first and second operating frequency bandwidths and less than a frequency bandwidth for the antenna system; a combining structure to couple first and second signal transmission paths from the antenna elements to the common input/output port; and a phase shifting element on the first signal transmission path that imparts a phase delay to signals on the first signal transmission path. The phase delay minimizes a sum of reflection coefficients of the
(Continued)

antenna elements to cause the frequency bandwidth for the antenna system to include at least the first and second operating frequency bands.

19 Claims, 15 Drawing Sheets

Related U.S. Application Data continuation of application No. 12/227,963, filed as application No. PCT/EP2007/055329 on May 31, 2007, now Pat. No. 9,007,275.

(60) Provisional application No. 60/812,548, filed on Jun. 9, 2006.

(51) Int. Cl.
*H01Q 3/36* (2006.01)
*H01Q 21/29* (2006.01)
*H01Q 21/00* (2006.01)

(52) U.S. Cl.
CPC ..... *H01Q 21/0006* (2013.01); *H01Q 21/0075* (2013.01); *H01Q 21/29* (2013.01)

(58) Field of Classification Search
USPC ..... 343/702, 844, 846, 850, 860, 853, 864
See application file for complete search history.

(56) References Cited

U.S. PATENT DOCUMENTS

| | | | |
|---|---|---|---|
| 4,723,305 | A | 2/1988 | Phillips |
| 5,231,406 | A | 7/1993 | Screenivas |
| 5,644,319 | A | 7/1997 | Chen |
| 5,724,666 | A | 3/1998 | Dent |
| 5,966,102 | A | 10/1999 | Runyon |
| 6,061,024 | A | 5/2000 | McGirr et al. |
| 6,184,844 | B1 | 2/2001 | Filipovic et al. |
| 6,198,943 | B1 | 3/2001 | Sadler |
| 6,281,850 | B1 | 8/2001 | Klostermann |
| 6,285,327 | B1 | 9/2001 | See |
| 6,317,084 | B1 | 11/2001 | Chen |
| 6,369,770 | B1 | 4/2002 | Gothard |
| 6,417,806 | B1 | 7/2002 | Gothard |
| 6,476,776 | B1 | 11/2002 | Kurby |
| 6,492,952 | B1 | 12/2002 | Hu |
| 6,509,883 | B1 | 1/2003 | Foti |
| 6,529,749 | B1 | 3/2003 | Hayes |
| 6,549,169 | B1 | 4/2003 | Matsuyoshi et al. |
| 6,614,400 | B2 | 9/2003 | Egorov |
| 6,621,455 | B2 | 9/2003 | Wang |
| 6,639,558 | B2 | 10/2003 | Kellerman |
| 6,639,560 | B1 | 10/2003 | Kadambi |
| 6,650,294 | B2 | 11/2003 | Ying |
| 6,693,603 | B1 | 2/2004 | Smith |
| 6,750,821 | B2 | 6/2004 | Fang et al. |
| 6,791,498 | B2 | 9/2004 | Boyle |
| 6,894,653 | B2 | 5/2005 | Chiang |
| 6,914,570 | B2 | 7/2005 | Asrani |
| 6,917,337 | B2 | 7/2005 | Iida |
| 6,937,196 | B2 | 8/2005 | Korva |
| 7,015,868 | B2 | 3/2006 | Puente Baliarda et al. |
| 7,046,202 | B2 | 5/2006 | Chiang |
| 7,064,713 | B2 | 6/2006 | Koenig |
| 7,079,079 | B2 | 7/2006 | Jo et al. |
| 7,199,762 | B2 | 4/2007 | Liu |
| 7,205,942 | B2 | 4/2007 | Wang |
| 7,310,536 | B2 | 12/2007 | Desclos |
| 7,358,925 | B2 | 4/2008 | Rosenberg |
| 7,468,698 | B2 | 12/2008 | Fujii |
| 7,511,675 | B2 | 3/2009 | Puente Baliarda et al. |
| 7,616,158 | B2 | 11/2009 | Mak |
| 7,656,353 | B2 | 2/2010 | Qi |
| 7,764,236 | B2 | 7/2010 | Hill |
| 8,421,686 | B2 | 4/2013 | Soler Castany et al. |
| 8,471,772 | B2 | 6/2013 | Puente Baliarda et al. |
| 8,558,741 | B2 | 10/2013 | Baliarda et al. |
| 8,674,887 | B2 | 3/2014 | Sanz et al. |
| 9,000,985 | B2 | 4/2015 | Puente Baliarda et al. |
| 9,054,418 | B2 | 6/2015 | Soler Castany et al. |
| 9,755,314 | B2 | 9/2017 | Puente Baliarda et al. |
| 2002/0000937 | A1 | 1/2002 | Kozakai |
| 2002/0021246 | A1 | 2/2002 | Market et al. |
| 2002/0149524 | A1 | 10/2002 | Boyle |
| 2003/0189518 | A1* | 10/2003 | Johnson ..... H01Q 1/245 343/702 |
| 2003/0189521 | A1 | 10/2003 | Yamamoto |
| 2004/0145521 | A1 | 7/2004 | Hebron |
| 2004/0145527 | A1 | 7/2004 | Mikkola |
| 2004/0212545 | A1 | 10/2004 | Li |
| 2004/0227680 | A1 | 11/2004 | Wen et al. |
| 2004/0257291 | A1 | 12/2004 | Man |
| 2005/0001769 | A1 | 1/2005 | Qi |
| 2005/0017906 | A1 | 1/2005 | Man |
| 2005/0030232 | A1 | 2/2005 | Monebhurrun et al. |
| 2005/0179607 | A1 | 8/2005 | Gorsuch |
| 2005/0200537 | A1 | 9/2005 | Jarmuszewski |
| 2005/0225488 | A1 | 10/2005 | Nakagawa |
| 2005/0237251 | A1 | 10/2005 | Boyle |
| 2006/0082505 | A1 | 4/2006 | Baliarda et al. |
| 2006/0214850 | A1* | 9/2006 | O'Riordan ..... H01Q 1/243 343/700 MS |
| 2007/0091008 | A1 | 4/2007 | Mortazawi |
| 2007/0236400 | A1 | 10/2007 | Rentz |
| 2008/0252538 | A1 | 10/2008 | Ying |
| 2009/0274072 | A1* | 11/2009 | Knox ..... H01Q 1/2225 370/278 |

FOREIGN PATENT DOCUMENTS

| | | |
|---|---|---|
| EP | 1280230 | 1/2003 |
| EP | 1569300 | 8/2005 |
| EP | 1662604 | 5/2006 |
| GB | 2347560 | 9/2000 |
| GB | 2391114 | 1/2001 |
| KR | 20090016494 | 2/2009 |
| WO | 97/26713 | 7/1997 |
| WO | 01/11716 | 2/2001 |
| WO | 01/54225 | 7/2001 |
| WO | 01/63695 | 8/2001 |
| WO | 02/13306 | 2/2002 |
| WO | 02/063712 | 8/2002 |
| WO | 02/065583 | 8/2002 |
| WO | 03/034545 | 4/2003 |
| WO | 03/077355 | 9/2003 |
| WO | 03/077360 | 9/2003 |
| WO | 03/096474 | 11/2003 |
| WO | 2004/025778 | 3/2004 |
| WO | 2004/038856 | 5/2004 |
| WO | 2004/066437 | 8/2004 |
| WO | 2004/084345 | 9/2004 |
| WO | 2005/008834 | 1/2005 |
| WO | 2005/081358 | 9/2005 |
| WO | 2005/099041 | 10/2005 |
| WO | 2006/034940 | 4/2006 |
| WO | 2006/070017 | 7/2006 |
| WO | 2007/028448 | 3/2007 |
| WO | 2007/039071 | 4/2007 |
| WO | 2007/128340 | 11/2007 |
| WO | 2008/045151 | 4/2008 |
| WO | 2008/119699 | 10/2008 |

OTHER PUBLICATIONS

Schaubert, D. et al., Proceedings of the 1999 Antenna Applications Symposium, 1999, vol. I, University of Massatchusetts.

Kitchener, D., "Multiband Terminal and Basestation Antennas for Mobile Communications" at 11th International Conference on antennas and Propagation, 2001, Conference Publication No. 480, IEE.

Azman, V. Conformal Antenna Arrays for 3G Cellular Base Stations

(56) References Cited

OTHER PUBLICATIONS (submitted for the degree of Bachelor of Engineering), 2002, pp. 18-19, University of Queensland, Australia.
Imel, K. J. and Hart, J. W, Understanding Wireless Communications in Public Safety: A Guidebook to Technology, Issues, Planning, and Management (A Program of the National Institute of Justice) 2003, pp. 58-61.
Rackley, R. and Folkert, M., Antennas for Medium-Frequency Broadcasting, 2005, duTreil, Lundin & Rackley, Florida.
Avendal , J. , Multiband diversity antenna performance study for mobile phones, Antenna Technology: Small and Smart Antennas Metamaterials and Applications (IWAT), 2007. IEEE International Workshop on, 2007030.
Balanis , C. A. , Antenna theory—Analysis and desing—Chapter 6—Arrays: linear, planar and circular, John Wiley and Sons, Jan. 1, 1997, pp. 249-257.
Collins , B. S. et al. , A multi-band hybrid balanced antenna, Antenna Technology : Small Antennas and Novel Metamaterials (IWAT), 2006. IEEE International Workshop on, Mar. 6, 2006.
Diallo, A. et al , Study and reduction of the mutual coupling between two mobile phone PIFAs operating in the DCS 1800 and UMTS bands, Antennas and Propagation, IEEE Transactions on, Nov. 1, 2006.
Du, Z. et al , A novel compact wide-band planar antenna for mobile handsets, Antennas and Propagation, IEEE Transactions on, Feb. 1, 2006.
Guo, Y., New compact six-band internal antenna, Antennas and Wireless Propagation Letters, IEEE, vol. 3, Jan. 2004.
Jensen, M.A. et al , Performance analysis of antennas for hand-held transceivers using FDTD, Antennas and Propagation, IEEE Transactions on, Aug. 1, 1994.
Lee, J.S. et al. , Triple band internal antenna using matching circuits, Antennas and Propagation Society (APS), 2005. IEEE International Symposium, Jul. 3, 2005, vol. 1A.
Lin, C. et al , Printed monopole slot antenna for internal multiband mobile phone antenna, Antennas and Propagation, IEEE Transactions on, Dec. 1, 2007, No. 12, vol. 55.
Lin, D. B. et al. , A compact quad-band PIFA by using defected ground structure, Antennas and Propagation Society (APS), 2007. IEEE International Symposium, Jun. 10, 2007.
Lindberg, P. et al , A bandwidth enhancement technique for mobile handset antennas using wavetraps, Antennas and Propagation, IEEE Transactions on, Aug. 1, 2006.
Liu , Z. D. ; Hall , P. S. ; Wake , D. , Dual-frequency planar inverted-f antenna, Antennas and Propagation, IEEE Transactions on, Oct. 1, 1997.
Nakano, H. et al , Realization of dual frequency and wide band vswr performances using normal mode helical and inverted f antennas, Antennas and Propagation, IEEE Transactions on, Jun. 6, 1998.
Ollikainen, J. et al. , Radiation and bandwidth characteristics of two planar multistrip antenna for mobile communications systems, Vehicular Technology (VTC), 48th , Ontario, 1998. IEEE Conference, May 1, 1998, vol. 2, pp. 1186-1190.
Ollikainen, J. et al. , Internal dual-band patch antenna for mobile phones, Antennas and Propagation, IEEE Transactions on, Apr. 9, 2000.
Ramirez, R.R. et al. , A mutual coupling study of circular polarized microstrip antennas with applications to diversity combining mobile communications, Antennas and Propagation Society (APS), 2001. IEEE International Symposium, Jul. 8, 2001.
Suvikunnas, P. et al. , Evaluation of the performance of multiantenna terminals using a new approach, Instrumentation and Measurement, IEEE Transactions on, Oct. 1, 2006.

* cited by examiner

DISTRIBUTED ANTENNA SYSTEM ROBUST TO HUMAN BODY LOADING EFFECTS

CROSS REFERENCE TO RELATED APPLICATIONS

This application is a continuation of U.S. patent application Ser. No. 14/635,568 filed Mar. 2, 2015, which is a continuation of U.S. patent application Ser. No. 12/227,963 filed Mar. 31, 2009, entitled "Distributed Antenna System Robust to Human Body Loading Effects," now U.S. Pat. No. 9,007,275, issued on Apr. 14, 2015, which is a National Phase application of International Application No. PCT/EP2007/055329, filed on May 31, 2007, which claims the benefit of U.S. Provisional Application No. 60/812,548, filed on Jun. 9, 2006, the entire contents of which are hereby incorporated by reference.

FIELD OF THE INVENTION

The present invention refers to an antenna system for wireless devices (that is, devices for wireless communication, such as devices involving means for radio frequency communication) and handset applications, that may feature a wide bandwidth. The invention further relates to the corresponding portable and/or handheld device including such an antenna system operating in, for example, a frequency range selected between 400 MHz and 6 GHz. It is an object of the present invention to provide an antenna system for a wireless device that substantially reduces the disadvantageous hand loading effects and thereby increases its performance.

In some embodiments, the present invention will take the form of a wireless handheld device, such as, for instance, a handset, a cell phone, a PDA, or a smart phone. Such a handheld device sometimes will take the form of a single-body compact device, while in other cases the device will include two or more bodies and a mechanical arrangement to move at least one of those bodies with respect to at least one of the other bodies through, for instance, a substantially co-planar displacement, a rotation around one or more axes, or a combination of both. Other embodiments of the present invention will take the form of a component including said antenna system suitable for wireless devices or an antenna system for a car.

In some embodiments, such a portable device will include hardware and/or software for wireless and/or mobile or cellular services, enabling the portable device to connect to a mobile or wireless network or device.

BACKGROUND

Antennas for wireless devices have to be small, which implies restrictions on the bandwidth. There is a well known trade-off between antenna size and bandwidth. The smaller the antenna, the smaller the bandwidth, and particularly, typical prior-art internal antennas for a handheld device feature a 5-15% relative bandwidth at frequencies such as those of typical cellular, mobile and wireless services (800 MHz-2200 MHz). When an internal antenna is operated outside its operating bandwidth, the gain, the efficiency and matching characteristics (VSWR, return-loss) of the antenna become severely degraded to unacceptable levels.

There are antenna systems for wireless devices featuring a wide bandwidth. Those antenna systems rely substantially on the radiating efficiency of the ground-plane or on a large antenna element, and are very sensitive to hand loading effects.

For instance, in an antenna system with a single large antenna element, when the user is operating the wireless device, the proximity of the hand to this large antenna element (in which the currents are high compared to the currents in the ground plane) facilitates an electrical coupling between the hand and the antenna element which may detune the antenna element, may change its impedance, and may in addition cause radiation losses.

It has been observed that known prior art solutions feature antenna elements typically located at the ends of the wireless handheld device. Thus, when the wireless handheld device is being operated, the hand does not shield/cover the antenna element and, therefore, the hand loading effects are minimized. There is a very obvious trade-off, since when the antenna element is made bigger to achieve a wide bandwidth, the hand loading effects increase as the area used by the antenna system increases.

As stated earlier, there are also prior art antenna systems featuring a wide bandwidth which rely largely on the radiating efficiency of the ground-plane. Since handheld devices feature a ground-plane which typically extends throughout the whole device, the antenna system ideally featuring a wide bandwidth becomes very sensitive to hand loading effects. As a result of the hand loading effects, the bandwidth is reduced or the whole antenna system may be detuned.

One of the challenges that antenna designers face is providing an antenna system for a handset that features a wide bandwidth while not being substantially influenced by hand loading. As previously stated, while reducing the size might provide a solution to the problem involved with the hand loading effects, the bandwidth and gain degradations introduced by the size reduction are usually unacceptable.

A particular technique of balancing antennas that minimizes the effect of hand loading is found in B. S. Collins, S. P. Kingsley, J. M. Ide, S. A. Saario, R. W. Schlub, and S. G. O'Keefe, "A multi-band hybrid balanced antenna," presented at the 2006 IEEE International Workshop on Antenna Technology: Small Antennas and Novel Metamaterials, White Plains, N.Y., Mar. 6-8, 2006. The paper describes a multi-band antenna incorporating a balanced feed network which shows substantial immunity to the usual ground-plane hand loading effects. Said technique is not satisfactory though, since the resulting antenna system has typically twice the size of the original antenna system.

There are several prior-art antennas, as described in patent application publ. no. WO-A-02/065583, entitled "Magnetic dipole and shielded spiral sheet antennas structures and methods," whose configuration and shape provide a shield to block radio frequency energy from being absorbed in a body. An antenna structure as disclosed in WO-A-02/065583 is designed so that radio frequency energy tends to flow in the direction away from a person. Those prior-art antennas allegedly feature a robust behavior to hand proximity influence, but their bandwidth appears to be insufficient for many practical applications.

Antenna combinations or multiple antenna sets, that is, antenna systems having at least two individual antenna elements whose output signals are combined, are generally known (for instance, Multiple-Input Multiple-Output MIMO and diversity systems).

Antenna diversity is a transmission technique useful in multipath environments. A multipath environment is one where the information-carrying signal is transmitted along different propagation paths. These propagation paths may experience different channel conditions (e.g., different fading, multipath, and interference effects) and may feature different signal-to-noise-and-interference ratios (SNRs). Therefore, the information-carrying signal can arrive through different paths and have different levels. Antenna designers configure diversity antenna systems in such a way that the two or more antenna elements are placed so that they are uncorrelated and, therefore, the information-carrying signal arriving to each one of them will not simultaneously feature minimum levels. A diversity combining circuit combines or selects the signals from the receiver antenna elements to constitute an improved quality signal.

Also, antenna arrays are used when the radiation characteristics required for a certain application are not achievable by a single antenna element. The arrangement of the antenna elements forming an array is normally so that the antenna array features a directive radiation pattern that provides a radiation maximum in a particular direction. Antenna arrays are typically used to achieve directivity in one or more orthogonal polarizations. In such antenna arrays, the distance between the antenna elements is usually larger than half of a free space operating wavelength of the antenna elements, and quite often substantially close to one free space operating wavelength (such as in the order of 0.8 or 0.9 wavelengths, or alike).

SUMMARY

One aspect of the present invention relates to a portable or handheld device comprising a reduced size distributed antenna system and/or a small size distributed antenna system which allows for sufficient bandwidth to cover the operating frequency band or bands while said antenna system is not substantially influenced by hand loading effects.

This problem is solved with the antenna system and handheld/portable device defined in the independent claims. Some embodiments of the invention are further defined in the dependent claims.

The present invention refers to a distributed antenna system (and to a handheld/portable device comprising it), said antenna system comprising a ground-plane and at least two antenna elements connected to at least one common input/output port (input and/or output port) for said antenna system, each of said antenna elements comprising one or more driven points, said antenna system further comprising means for routing and transmitting the signal from said at least two antenna elements towards said common input/output port, and a combining (and/or dividing) means to interconnect the signals from (and/or separate the signals to) said at least two antenna elements to (and/or from) said common input/output port, and at least one phase shifting element, such as a for instance a transmission line (micro coaxial cable, microstrip, stripline or coplanar transmission line, to name a few examples), a reactive network (based on inductors and capacitors), an active phase shifter (based on a combination of diodes and/or transistors) or a combination of them, placed between at least one of said driven points and the combining structure of the system.

The phase shifting element features a phase shift or an equivalent electrical length that cancels or at least minimizes the sum of the reflection coefficients of said at least two antenna elements measured at said input/output port.

The operating bandwidth of one antenna element (or the bandwidth of two, or three, or more individual antenna element, or even the combined bandwidth of two, three or more antenna elements) can be substantially smaller than the operating bandwidth of the antenna system.

Said phase shift can be arranged to minimize said sum of the reflection coefficients so that, for any (i.e., for every) antenna element of the antenna system, the maximum value, within the entire operating bandwidth of the antenna system, of the modulus of the reflection coefficient of the antenna system (i.e., the sum of the reflection coefficients of said antenna elements of the antenna system) measured at said common input/output port, is smaller than the maximum value, within the entire operating bandwidth of the antenna system, of the modulus of reflection coefficient of said antenna element measured at its driven point; and/or for any (i.e., every) antenna element of the antenna system, and for a given threshold value, the width of the frequency interval for which the modulus of the reflection coefficient of the antenna system measured at said common input/output port is smaller than said threshold value, is larger than the width of the frequency interval for which the modulus of the reflection coefficient of said antenna element measured at its driven point is smaller than said threshold value.

Suitable threshold values can be, for example, ⅓, ½, ⅗ or ⅔. In this way, by means of the phase shift, the effective reflection coefficient of the antenna system measured at the common input/output port can, at least for the frequencies within the operating bandwidth of the antenna system or of the device in which the system is incorporated, be much smaller than what it would have been had the corresponding phase shift or phase shifts not have been imposed on the signals, by means of said at least one phase shift element.

Thus, the at least one phase shift element enhances the performance of the antenna system throughout said operating band of the antenna system, while the use of several smaller antennas reduces the influence of the hand loading effects.

In some examples it will be advantageous to have one or more antenna elements built on, for instance, a substantially planar substrate. In the same manner, in some embodiments one or more antenna elements will take the form of a surface mount device (SMD) element. Advantageously, some embodiments comprise at least one antenna element featuring a high permittivity dielectric substrate (with a relative dielectric permittivity higher than, for instance, 2, 3, 4, 5 or 6, such as, for instance, a ceramic or glass material, to name a few examples) arranged in one or more layers and, optionally, a shaped conductive trace upon one or more of the surfaces of said substrate layer or layers.

In some embodiments of the present invention, the antenna elements for the distributed antenna system are usually arranged such that the distance between any pair of antenna elements is substantially shorter than an operating wavelength of said elements, and in some cases, shorter than half the wavelength.

As mentioned earlier, while in a directive array the multiple antenna elements are designed to be substantially in-phase to provide such a directive pattern, in the present invention one or more of the elements is substantially shifted in phase with respect to one or more of the other elements to improve the bandwidth of the system. While in an array the bandwidth of each individual element is usually adjusted to match the operating bandwidth of the array system, in the present invention, the bandwidth of the individual antenna elements might be substantially smaller than the operating bandwidth of the antenna system.

In this text, the expression bandwidth preferably refers to a frequency region over which an antenna element or an antenna system complies with certain specifications, depending on the service for which the wireless device including said antenna element or said antenna system is adapted. For example, for a wireless device adapted to transmit and receive signals of cellular, mobile or wireless services, an input return-loss of −3 dB or better (i.e., smaller), or equivalently a reflection coefficient having a modulus of ½ or better, within the corresponding frequency region can be preferred.

The means for routing the signals from the antenna elements to the input/output port(s) may, for instance, comprise a transmission line (such as, for instance, a microstrip, stripline or coplanar transmission line, to name a few examples) or other analogous means for the transmission of radio frequency (RF) signals. In fact, when using a transmission line for routing the signals from one or more antenna elements, said transmission line may in turn operate as a phase shifting element for the antenna system, provided that the length of said transmission line is adjusted accordingly (for example, with regard to the length of the transmission lines used for the other antenna element(s)).

The reflection coefficient relates to the fraction of an incident signal that gets reflected back from a load, said load being, for example, an antenna element.

Typically, when a phase shifting element is connected to an antenna element, the reflection coefficient of the assembly comprising said phase shifting element plus antenna element (the assembly now being the load) is the ratio between the signal reflected back from the assembly (or reflected signal) and the signal originally injected into the assembly (or incident signal).

Said reflected signal is therefore the fraction of the incident signal originally injected into the assembly that has traveled through the phase shifting element towards the antenna element, has been then partially reflected by the antenna element, and has finally traveled back through the phase shifting element to reach the point at which the incident signal was injected into the assembly. Thus, the phase shift introduced by the phase shifting element is doubled, as it has to be considered over a round trip to the antenna element.

A difference in length corresponding to a one-way phase shift in the order of $\pi/2$ (90°) (plus any multiples of $\pi$), implying a round-trip phase shift of $\pi$(180°) can be appropriate.

The combining structure may be of any kind and many suitable structures are well known in the art, ranging from, for instance, a simple junction of two or more transmission lines, to a more sophisticated passive or active network such as a power combiner, a hybrid circuit element, a directional coupler, a signal processor, or alike.

The distributed antenna system according to the present invention is based on combining two or more antenna elements. An antenna system of the present invention features an effective electromagnetic volume which is larger than the sum of the individual volumes of each antenna element within the system. That is, the quality factor of an antenna system of the present invention is lower than that of an antenna whose volume was the sum of the individual volumes of each antenna element within the system. In some embodiments, the effective antenna volume is substantially equivalent to that of the whole wireless device. The effective electromagnetic volume is the volume utilized in terms of radiation. The distributed antenna system of the invention comprises at least two small antenna elements that occupy a relatively small area of the PCB. In fact, the area occupied by all of them can be smaller than the area of a conventional single-element antenna system. An advantage of the distributed antenna system is that while the occupied area is smaller, the effective electromagnetic volume of radiation is in some cases equal to or close to that of the whole wireless device. Thereby, while the footprint of the distributed antenna elements on the printed circuit board (PCB) of the wireless device may become smaller than that of a conventional single element antenna system (for instance, smaller than 50%, 40%, 30%, 20%, 15% or 10% of the footprint of a rectangular PIFA antenna element operating at the same lowest frequency band), the effective antenna volume may become even larger than the one featured by the corresponding conventional single element antenna system.

It is relevant to point out that the individual antenna elements may feature a small bandwidth when compared to the bandwidth required to cover the operating frequency band or bands of the wireless device. The reduced size of the individual antenna elements constrains the bandwidth achieved by each of them, for instance, to a bandwidth value below 80%, 60%, 50%, 40%, 30% of the required bandwidth. Through the combination of such narrow bandwidth antenna elements according to the present invention, the full required bandwidth for the system can be achieved.

As mentioned earlier, while in an array the bandwidth of each individual element is usually adjusted to cover the operating frequency band or bands of the array system, in the present invention, the bandwidth of the individual antenna elements may be substantially smaller than the resulting bandwidth of the antenna system. One of said antenna elements can be tuned to at least one resonant frequency that is substantially different from a resonant frequency of another one of said antenna elements, for example, two of the antenna elements can be tuned to substantially different resonant frequencies within the same operating band of the antenna system.

It is therefore an advantage of the present invention that when said antenna elements are combined in a distributed antenna system, a sufficient bandwidth to cover the operating frequency band or bands is achieved.

By having at least a second antenna element, it is possible to change the current distribution of the whole distributed antenna system in such a manner that the currents are minimum in most of the PCB except for the area occupied by the antenna elements. In other words, the antenna system of the present invention increases the contribution (in terms of radiation) of the antenna elements and reduces the contribution of the ground-plane. By doing so, this solution relies less on the ground-plane radiation efficiency and is thus less sensitive to hand loading, while still keeping a wide bandwidth and maintaining a small size.

In accordance with an advantageous embodiment of the invention, the signals reflected from each (or at least from two) of the individual antenna elements are added substantially in phase opposition. The signals are added by means of the phase shifting element, the means for routing and transmitting the signal and the combining means. For example, the phase shift element(s) can be arranged so that a signal received substantially simultaneously at two of said at least two antenna elements gives rise to respective received signals that are added substantially in phase opposition at the combining means. Substantially in phase opposition can imply a phase difference of, for example, 150-210 degrees, or 160-200 degrees.

In some embodiments, the individual antenna elements are advantageously connected by way of a phase shifting element, preferably a quarter wavelength phase shifting element (whereby the phase shift equivalent to a round trip through said phase shifting element will be in the order of 180 degrees), such as a transmission line, and in this way the reflected antenna signals are added in phase opposition.

In some embodiments the antenna system comprises 2, 3, 4, 5 or more ('N') antenna elements. Said antenna elements may be tuned at the same or slightly different resonant frequencies (same resonant frequencies can typically imply that one frequency is not more than 1% higher than the other, while slightly different resonant frequencies can typically imply that one frequency is more than 1% higher than the other frequency, but less than 5% higher). In some embodiments, the two or more antenna elements will be tuned to different frequencies (for example, the resonant frequency of one antenna element can be 5% or more higher than the resonant frequency of another antenna element) or even at frequencies corresponding to different operating frequency bands of the resulting antenna system.

If the antenna elements are multiband antenna elements, what has been stated above can apply to one or more of the frequency bands of these antenna elements. Also, one or more of the frequency bands of an antenna element can coincide with or overlap with one or more of the frequency bands of another one of the antenna elements.

In some embodiments the antenna system according to the present invention achieves the cancellation (or, at least, a substantial reduction) of the reflection coefficient of at least two antenna elements. Said at least two antenna elements are connected through, for instance, a transmission line. The electrical length of said transmission line depends on the modulus and phase of the input reflection coefficient ($S_{nn}$) of each of the antenna elements of the antenna system.

In one embodiment, all the antenna elements are tuned to substantially the same resonant frequency and feature substantially equal modulus and phase of $S_{nn}$ at f1, and a quarter wavelength transmission line (that is, implying a round trip delay of half a wavelength or 180 degrees) in about a half of the antenna elements will cause the total $\Gamma_{in}$ (reflection coefficient of the combined antenna elements as measured at the input/output port) to be null or minimum at f1, where f1 is the resonant frequency of each of the antenna elements.

In some embodiments the antenna elements will be placed at different locations within the wireless system or device. In some embodiments said elements will be tuned to slightly different resonant frequencies to provide a customized input reflection coefficient ($S_{nn}$) throughout the operating band. Such a customized reflection coefficient will in some cases be tuned through the electrical length and impedance of the transmission line and/or the phase shifting element(s). By modifying the characteristic impedance and electrical length of the transmission line, the reflection coefficient of the antenna system as measured at the input/output port ($\Gamma_{in}$) can be minimized for f1 or through an entire frequency range by using for instance a microwave network optimization tool. For instance, the $\Gamma_{in}$ response within the operating frequency range can be adjusted in some embodiments to feature a response substantially close to a maximally flat (Butterworth) response, a constant ripple (Chebyshev) response, or other typical characteristic responses of a distributed RF matching network or filter.

A particularly advantageous embodiment of the distributed antenna system in accordance with the present invention resides in that at least two of the individual antenna elements are part of a diversity antenna combination. In such an embodiment, the combining structure takes the form of a diversity processor.

In some examples, a distributed antenna system according to the present invention comprises at least one antenna element having a resonant frequency outside the operating bandwidth, and preferably above the highest frequency of the operating bandwidth, of said antenna system. That is, the antenna system comprises at least one antenna element that is non-resonant within the operating bandwidth of the antenna system.

In these examples, the antenna system preferably comprises a matching and tuning circuit connected to the driven point of said at least one antenna element. Said matching and tuning circuit modifies the impedance of the antenna element so that the modulus of the reflection coefficient of said antenna element presents a minimum within the operating band of the antenna system.

An antenna element with a resonant frequency above the highest frequency of the operating bandwidth of the antenna system can be advantageously smaller than if it had its resonant frequency within said operating bandwidth, facilitating even more the integration of the antenna elements of the antenna system within a wireless device.

Two or more distributed antenna systems according to the invention can be combined to form a higher level distributed antenna system.

For example, two or more distributed antenna systems, each operating in a different frequency region of the electromagnetic spectrum, can be combined through combining means to form a higher level distributed antenna system. Said combining means may comprise a diplexer or a bank of filters to separate the electrical signals of the different frequency regions of operation of the distributed antenna system.

In some embodiments each of the antenna elements covers a certain portion of the required operating bandwidth, whereby the antenna elements complement each other.

The combination of two or more small antenna elements according to the present invention makes it possible to obtain the required gain that otherwise had not been obtained by a single antenna. At the same time, the contribution of the PCB (ground-plane) is kept small, which makes it possible to reduce the overall influence of the hand loading effects.

In some preferred embodiments the wireless device is operating at one, two, three, four, five or more of the following communication and connectivity services. In some preferred embodiments a wireless (e. g. handheld or portable) device including a distributed antenna system according to the present invention is operating at one, two, three, four, five or more of the following communication and connectivity services: Bluetooth, WiMAX, ZigBee, ZigBee at 860 MHz, ZigBee at 915 MHz, GPS, GPS at 1.575 GHz, GPS at 1.227 GHz, Galileo, GSM 450, GSM 850, GSM 900, GSM 1800, American GSM, DCS-1800, 3G, 4G, HSDPA, UMTS, CDMA, DMB, DVB-H, WLAN, WLAN at 2.4 GHz-6 GHz, PCS 1900, KPCS, WCDMA, SDARs, XDARS, DAB, WiFi, UWB, 2.4-2.483 GHz band, 2.471-2.497 GHz band, IEEE802.11ba, IEEE802.11b, IEEE802.11g and FM.

In some preferred embodiments a wireless (e. g. handheld or portable) device including a distributed antenna system according to the present invention is operating at one, two, three, four, five or more frequency bands corresponding to one, two, three, four, five or more communication standards within the following regions of the electromagnetic spectrum: the 810 MHz-960 MHz region, the 1710-1990 MHz region, and the 1900-2170 MHz region.

One of the advantages of the present invention is that the device is able to keep its performance in normal operating conditions when the user is holding the device with his hand and/or close to his body. The particular arrangement of the antenna inside the device and with only a small contribution of the ground-plane to the radiating efficiency of the whole antenna system makes it possible to minimize the effect of the human body on the signal reception.

Another aspect of the present invention relates to the use of the antenna system of the invention in a wireless device, for reducing hand loading effects while preferably substantially achieving an adequate operating bandwidth.

Another aspect of the invention relates to a method of reducing the hand loading effects related to a wireless device, comprising the step of providing the wireless device with said antenna system.

DETAILED DESCRIPTION

Figure 9:
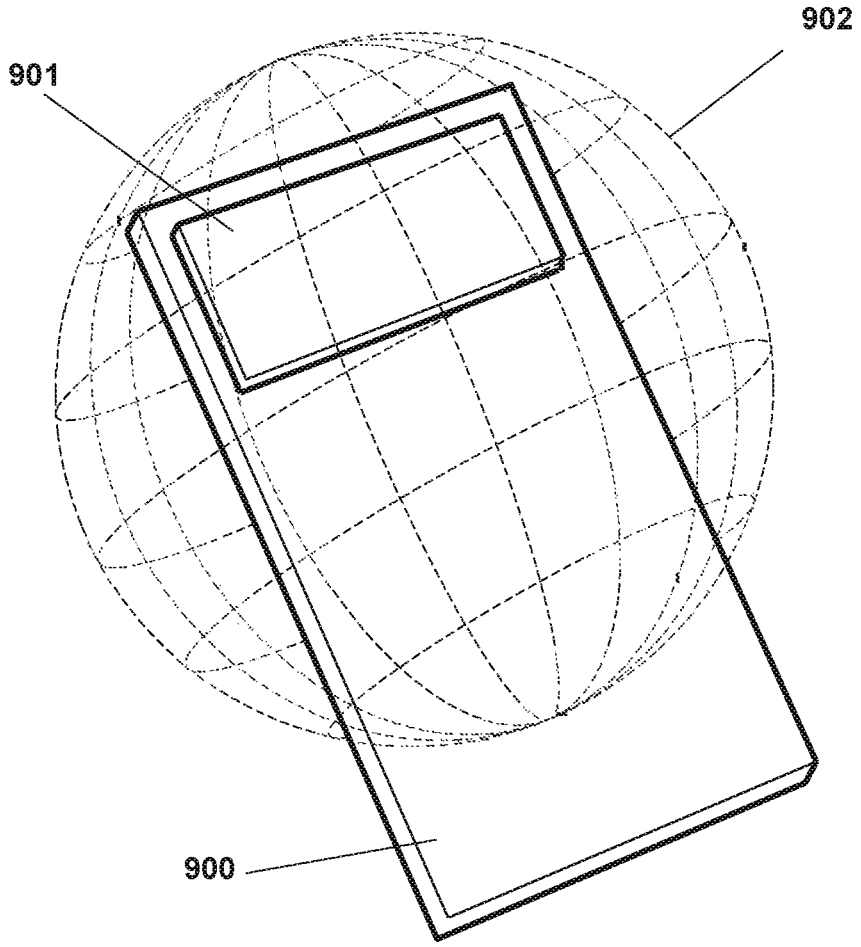
FIG. 9—Prior art antenna system.

FIG. 9 describes a prior art antenna system. The antenna system comprises a ground-plane 900 and an antenna element 901. Usually such a ground-plane 900 is embedded in a multilayer printed circuit board (PCB) which hosts the electronics and other components (such as integrated circuits, batteries, handset-camera and speakers, LCD screens, vibrators) of the whole device. Antenna designers often have to design and locate the antenna system at an end of the wireless handheld device. The area and volume available are very scarce and, typically, due to influence of other components and circuits, the possibilities of positioning the antenna element 901 in relation to the PCB are very limited. It can be seen in FIG. 9 that the antenna element 901 uses a considerable area on the PCB and that it is located at the top end thereof.

The figure also shows an effective electromagnetic volume 902 that such an antenna system can typically utilize for its radiation.

Figure 10:
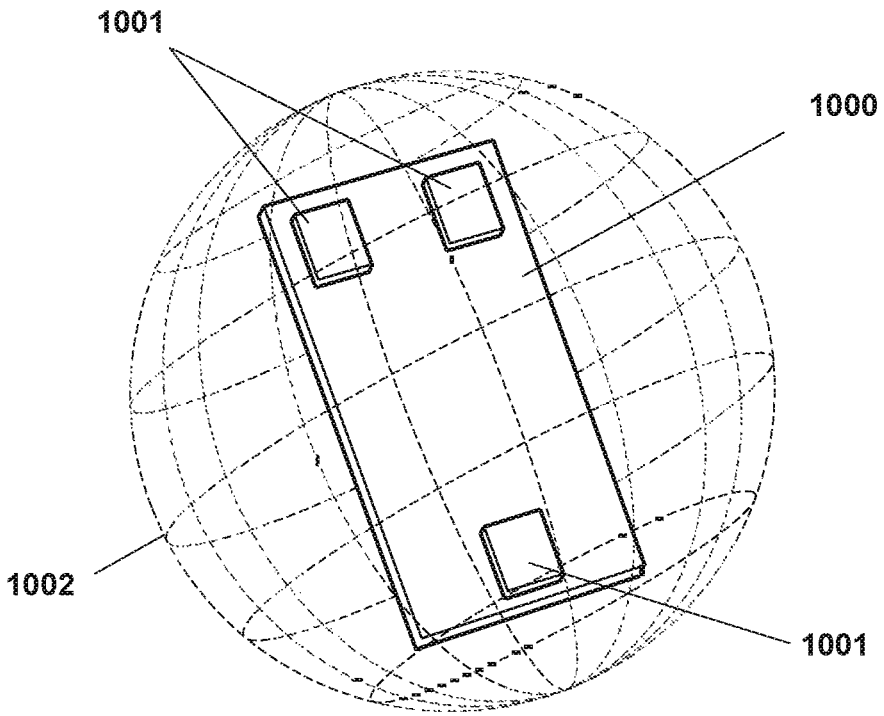
FIG. 10—Antenna system according to an embodiment of the present invention.

FIG. 10 illustrates a distributed antenna system comprising a ground-plane 1000 and three antenna elements 1001. It can be seen in FIG. 10 that the distributed antenna system uses a smaller area on the PCB since the three antenna elements 1001 use an area smaller than that of the antenna element 901 in FIG. 9. The three antenna elements 1001 depicted are identical but it is clear to the person skilled in the art that they could be different as well. The antenna elements 1001 are close to the shorter ends of the PCB, two of them at the top and one of them centered at the bottom of the PCB. They could be located elsewhere. It can be understood from FIG. 10 that the distributed antenna system provides great design flexibility. The three antenna elements 1001 use a smaller total area and each of them individually uses a significantly small area increasing the possibilities of integrating other electronics and other components (not depicted). Antenna designers have a greater flexibility to design and locate their antenna system and the area and volume available for integrating other electronics and other components is increased.

FIG. 10 also shows an effective electromagnetic volume 1002 that such a distributed antenna system can utilize for its radiation and as it can be seen it becomes larger than that of the antenna system of FIG. 9.

Figure 11:
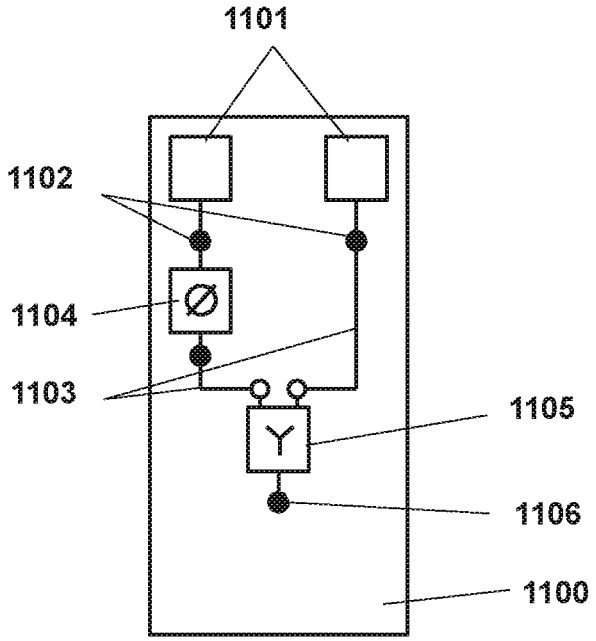
FIG. 11—Diagram view of an antenna system according to an embodiment of the present invention.

In FIG. 11 a schematic diagram of a distributed antenna system according to an embodiment of the present invention is shown. Two antenna elements 1101 are mounted at the top end of a PCB, which features a ground plane 1100 layer, of an antenna system for a wireless device. As it will be made clear from the different embodiments shown in FIG. 12, other configurations are also possible and different numbers and types of antenna elements may be used.

FIG. 11 shows two antenna elements 1101 driven by their respective driven points 1102 and the antenna element placed at the left hand top of the PCB (one layer of which corresponds to the ground plane layer 1100) is connected at its driven point 1102 to a phase shifting element 1104. Both antenna elements 1101 are connected through means for routing and transmitting the signal 1103 to combining means 1105 that interconnect or combine the signals from antenna elements 1101 to the input/output port 1106. The input/output port 1106 of the distributed antenna system depicted in FIG. 11 can, for example, interconnect the antenna system with an RF module (not illustrated in FIG. 11). The phase shifting element 1104 may for instance be a transmission line (such as a micro coaxial cable, a microstrip line, a stripline or a coplanar transmission line, to name a few examples), a reactive network (based on inductors and capacitors), an active phase shifter (based on a combination of diodes and/or transistors) or a combination thereof. Generally, the positions of the phase shifting element 1104 and the interconnection means 1103 might be exchanged. Also, the use of one phase shifting element in correspondence with more than one antenna elements is possible within the scope of the present invention. In FIG. 11, the entire antenna elements 1101 are placed over the ground-plane 1100 layer of the PCB. In other embodiments of the present invention, the at least two antenna elements may be placed totally over, partially over or adjacent to the ground-plane layer of the PCB.

Figure 12:
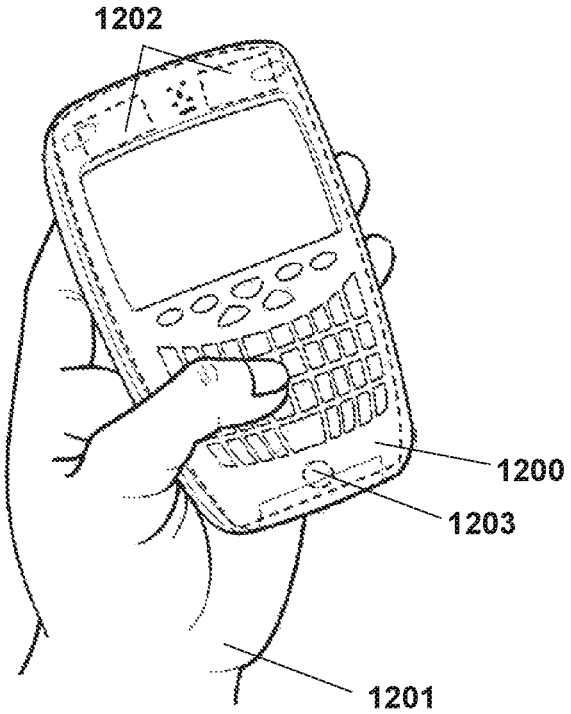
FIG. 12—Wireless device (here a PDA-like mobile telephone) in combination with a distributed antenna system according to an embodiment of the invention.

FIG. 12 shows a typical PDA-like mobile telephone which comprises an antenna system 1200 according to the present invention. It can be seen how when operating the PDA-like mobile telephone, the hand 1201 does not cover the antenna elements 1202, 1203 of the distributed antenna system and therefore the hand loading effects are minimized. The antenna elements 1202 have been designed so that they have a small footprint on the PCB leaving sufficient space for other components such as speakers, IR port, etc. The small footprint of the two antenna elements 1202 makes it possible to increase the size of the display without increasing the size of the wireless device. The distributed antenna system of FIG. 12 features a wide bandwidth while being less influenced by hand loading effects. It achieves a wide bandwidth since the effective electromagnetic volume is larger than the sum of the individual volumes of the antenna elements 1202 and 1203.

Figure 13:
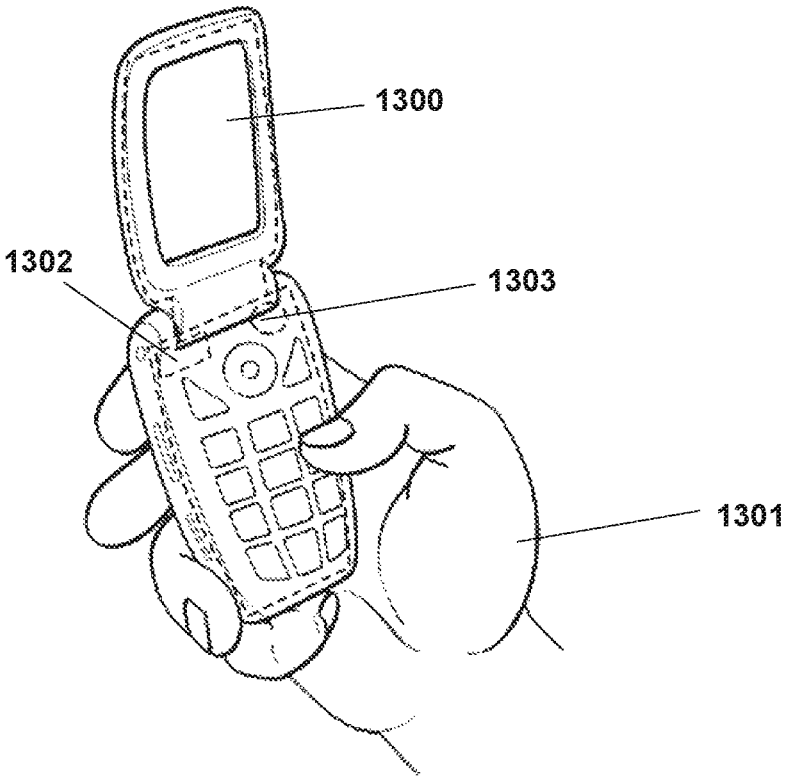
FIG. 13—Wireless device (here a clam-shell type mobile telephone) in combination with a distributed antenna system according to an embodiment of the invention.

FIG. 13 shows a typical clamshell-like mobile telephone which comprises an antenna system 1300 according to the present invention. The antenna elements 1302, 1303 have been designed so that they have a small footprint on the PCB leaving sufficient space for other components. The distributed antenna system of FIG. 13 features a wide bandwidth while not being substantially influenced by hand loading 1301. It achieves a wide bandwidth since the effective electromagnetic volume is larger than the sum of the individual volumes of the antenna elements 1302 and 1303.

In FIGS. 14A-14I, some possible distributed antenna system configurations are shown. The examples shown are not limitative but indicative of some possible arrangements of the distributed antenna system according to the present invention. In particular, different combinations of the features of the examples shown in FIGS. 14A-14I are possible within the scope of the invention.

Figure 14A:
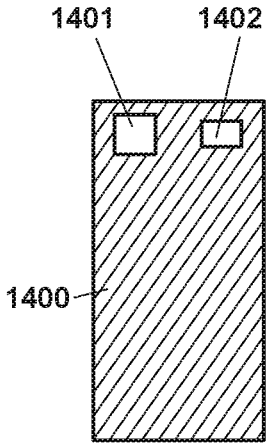
FIGS. 14A-14I—Schematic views of some distributed antenna system configurations for a bar-type wireless handheld device, according to some embodiments of the invention.

In FIG. 14A two antenna elements 1401, 1402 are placed at the top portion of the PCB near the shorter edge of the PCB. Although top and bottom parts of the device in the FIGS. 14A-14I correspond to top and bottom parts of the drawing page as well, generally the positions of the elements might be changed from the top to the bottom and vice versa. The antenna elements 1401, 1402 are different and may have different (or slightly different) resonant frequencies and are placed entirely over a ground-plane layer 1400 of the PCB, that is, the orthogonal projections of these antenna elements on the plane housing the ground-plane are entirely within the boundary of the ground-plane (in other embodiments of the invention, the antenna elements may be only partially placed over the ground-plane, or they may even be situated beyond the edges of the ground-plane, that is, so that they do not feature any footprint on the ground-plane layer).

Figure 14B:
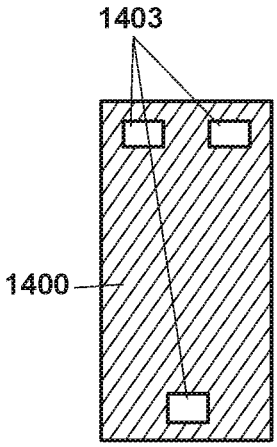

In FIG. 14B three antenna elements 1403 having identical or nearly identical resonant frequencies are placed entirely (although they could also be superimposed partially) over a ground-plane layer 1400 of the PCB. Two of them are placed at the top portion of the PCB, near the shorter edge of the PCB, and a third one is placed at the bottom portion of the PCB, near the shorter edge of the PCB.

Figure 14C:
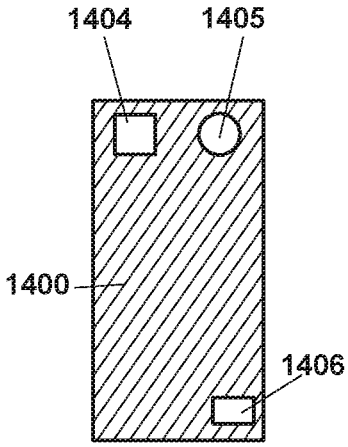

In FIG. 14C three antenna elements 1404, 1405, 1406 having different resonant frequencies are placed entirely over a ground-plane layer 1400 of the PCB. Two of them are placed at the top portion of the PCB, near the shorter edge of the PCB, and a third one is placed at the bottom left corner of the PCB. The antenna elements 1404, 1405 and/or 1406 may take the form of a surface mount device (SMD) element.

One or more antenna elements may be integrated in an integrated circuit (IC) package. In some embodiments, said package may comprise said antenna element and at least one additional circuit element. In some embodiments, said circuit element is a matching network. In some embodiments, said element is a passive network, and in some cases, a reactive network. In some embodiments, said IC package includes a phase shifting network. In some embodiments, said IC package includes the combining means.

Figure 14D:
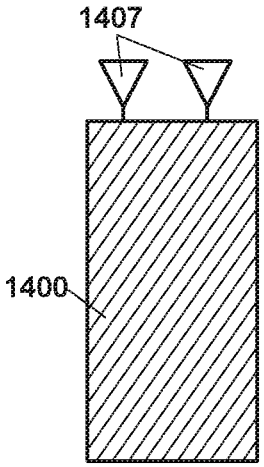

In FIG. 14D two antenna elements 1407 are placed at the top portion of the PCB, near the shorter edge of the PCB and protruding out of the ground layer or ground-plane 1400 on the PCB. As can be seen from FIG. 14D, the antenna elements 1407 actually protrude out of the PCB completely. The antenna elements 1407 may however still be mounted as an internal antenna as long as the required footprint and volume may be arranged inside the housing of the wireless terminal. The antenna elements 1407 substantially have the same electrical length and resonate at substantially the same frequency.

Figure 14E:
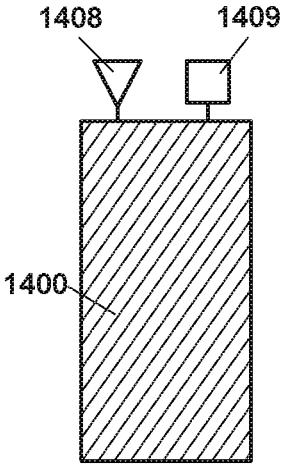

In FIG. 14E two antenna elements 1408, 1409 having different resonating frequencies are placed near the shorter edge of the PCB and protruding out of the PCB. As can be seen from FIG. 14E, the ground-plane layer 1400 extends as a continuous layer along the whole surface of the PCB and therefore the antenna elements 1408, 1409 protrude out of the PCB and its ground-plane layer 1400.

Figure 14F:
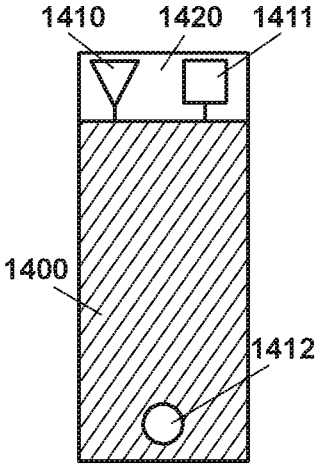

In FIG. 14F an antenna system comprising three antenna elements 1410, 1411, 1412 having different resonating frequencies is shown. Two antenna elements 1410, 1411 are placed at the top portion of the PCB, near the shorter edge of the PCB. As it can be seen from FIG. 14F, the antenna elements 1410, 1411 do not strictly protrude out of the PCB but it is instead the ground-plane layer 1400 of the PCB (not necessarily the PCB itself) that is cut out to leave a clearance 1420 for the antenna elements 1410, 1411. In some embodiments, two, three or more, or even every layer of said PCB includes such a clearance 1420 in order not to block or disturb the antenna operation. A third antenna element 1412 is placed at the bottom of the PCB over its ground-plane layer 1400.

Figure 14G:
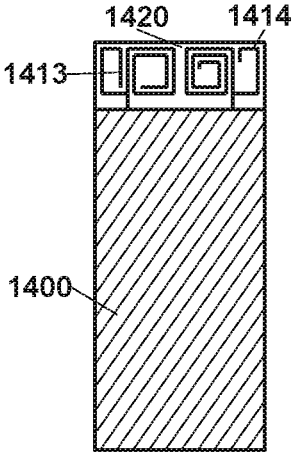

In FIG. 14G two antenna elements 1413, 1414 are placed at the shorter edge of the PCB and protruding out of the ground layer or ground-plane 1400 on the PCB. As it can be seen from FIG. 14G, the antenna elements 1413, 1414 do not strictly protrude out of the PCB but it is instead the ground-plane layer 1400 of the PCB that is cut out to leave a clearance 1420 for the antenna elements 1413, 1414. Each of the antenna elements 1413, 1414 is a multifrequency antenna element resonating at two or more frequencies. Said two or more frequencies may be the same or may be different for the different antenna elements. In some embodiments, like for instance the one depicted in FIG. 14G, such a multifrequency response on at least one of the elements is achieved by a radiating structure comprising two or more radiating arms of different lengths. The antenna elements could well be made by shaping a conductive trace upon one or more of the surfaces of a substrate layer or layers made of a high permittivity dielectric material (with a relative dielectric permittivity higher than, for instance, 2, 3, 4, 5 or 6, such as a for instance a ceramic or glass material, to name a few examples) of the PCB.

Figure 14H:
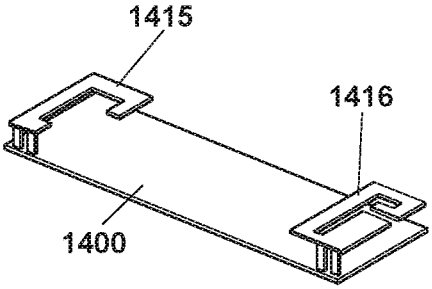

In FIG. 14H the antenna elements 1415, 1416 are PIFA antenna elements (radiating structures placed over a ground-plane for a substantial portion of the footprint of the element, said element including at least one feeding point and at least one shorting point). The antenna elements 1415, 1416 are placed at the top and bottom portion over a ground-plane layer 1400, near the shorter edge of the PCB.

Figure 14I:
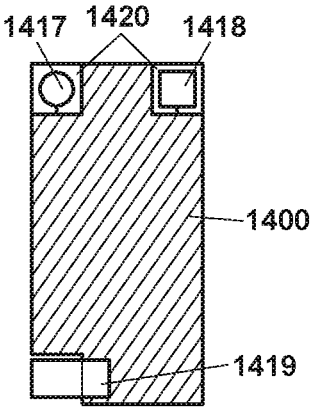

In FIG. 14I an antenna system comprising three antenna elements 1417, 1418, 1419 having different resonating frequencies is shown. Two antenna elements 1417, 1418 are placed at respective corners of the top portion of the PCB, near the shorter edge of said PCB. As it can be seen from FIG. 14I, the antenna elements 1417, 1418 do not protrude out of the PCB but the ground-plane layer of the PCB is cut out to leave a clearance 1420 for the antenna elements 1417, 1418. A third antenna element 1419 is placed at the bottom left corner of the PCB. It can be seen that the antenna element 1419 is superimposed partially over a ground-plane layer 1400 of the PCB. It can be seen as well that the PCB and all its layers have been cut out in its bottom left corner so that the antenna element 1419 is superimposed only partially over a ground-plane layer 1400 of the PCB.

Figure 15A:
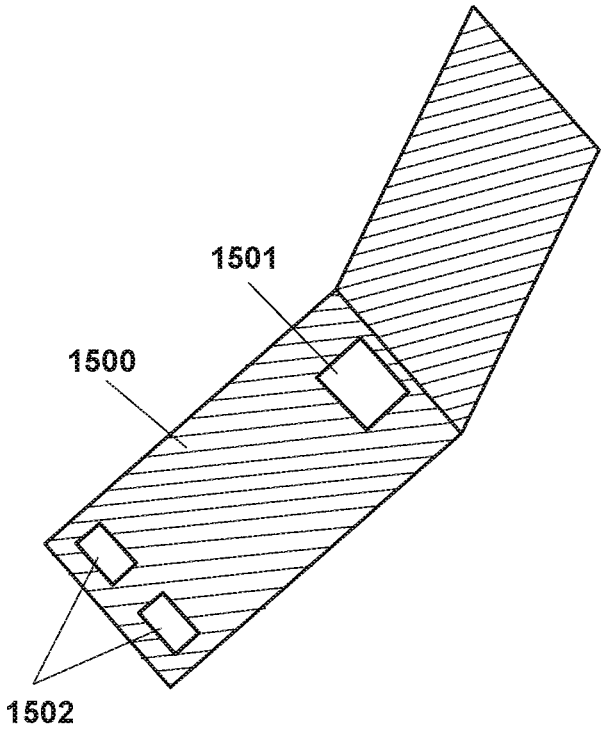
FIGS. 15A-15B—Schematic views of distributed antenna system configurations for a clam-shell-type wireless handheld device, according to some embodiments of the invention.
Figure 15B:
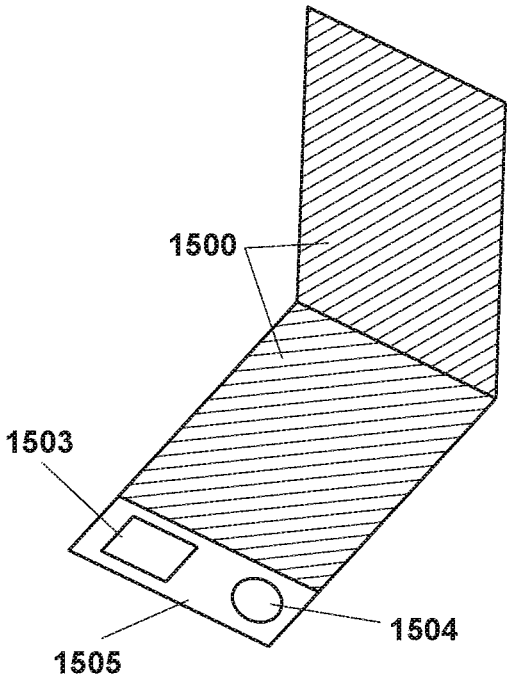

In FIGS. 15A-15B, some possible distributed antenna system configurations are shown.

In FIG. 15A three antenna elements 1501, 1502 having different resonant frequencies are placed entirely over a ground-plane layer 1500 of a two-piece PCB typical of a clamshell phone or wireless device. Two elements 1502 are placed at the bottom part near the shorter edge of the bottom PCB. Antenna element 1501 is placed centered at the top part of the bottom PCB near the hinge of a typical clamshell phone.

In FIG. 15B two antenna elements 1503, 1504 having different resonant frequencies are placed at the bottom part near the shorter edge of the bottom PCB. The PCB has been provided with a clearance 1505 so that the antenna elements 1503, 1504 protrude out of the ground layer or ground-plane 1500 on the PCB.

Figure 16A:
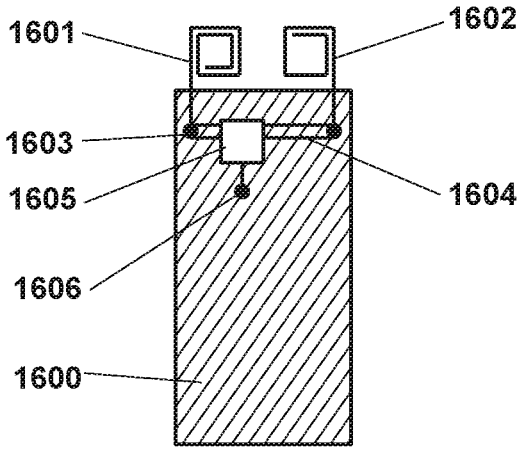
FIGS. 16A-16C—Schematic views of distributed antenna system configurations, according to some embodiments of the invention.

In FIG. 16A two antenna elements 1601, 1602 are placed at the top portion of the PCB near the shorter edge of the PCB. The antenna elements 1601, 1602 feature different electrical lengths and protrude out the ground-plane layer 1600 of the PCB. Both antenna elements 1601, 1602 are connected at their respective driven points 1603 through a microstrip line 1604. The phase shifting element and combining means are implemented in a single passive network 1605 such as for instance a reactive LC network and connect to common input/output port 1606.

Figure 16B:
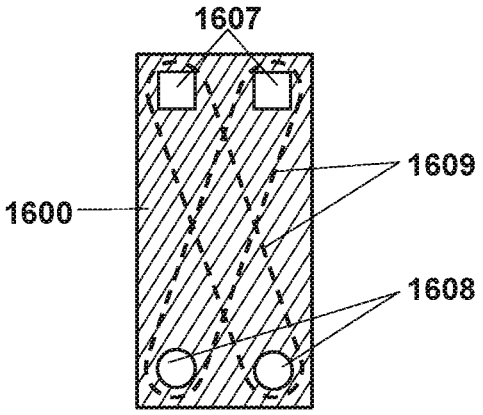

FIG. 16B shows a diversity system. Two distributed antenna systems 1609 comprising two different antenna elements 1607, 1608 are combined in a diversity system.

Figure 16C:
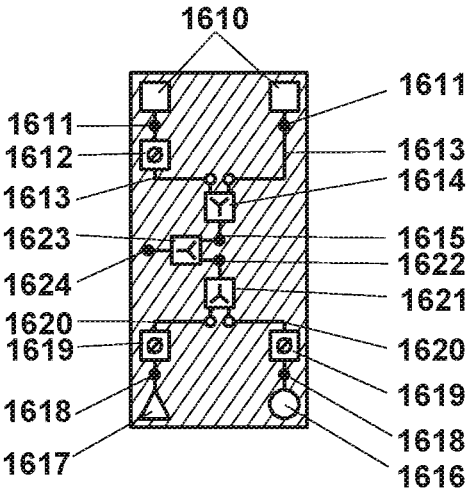

FIG. 16C shows how two distributed antenna systems according to the invention are combined to form a higher level distributed antenna system. In FIG. 16C two antenna elements 1610 are mounted at the top end of a PCB totally over the ground-plane layer of said PCB. The antenna elements 1610 are driven by their respective driven points 1611 and the antenna element placed at the left hand top of the PCB is connected at its driven point 1611 to a phase shifting element 1612. Both antenna elements 1610 are connected through means for routing and transmitting the signal 1613 to combining means 1614 that interconnects the signals from antenna elements 1610 to the input/output port 1615. As it can be seen in FIG. 16C, two more antenna elements 1616, 1617 having different electrical lengths are mounted over the PCB at the bottom end of said PCB. The antenna elements 1616, 1617 are driven by their respective driven points 1618 and through their respective driven points 1618 they are connected to their respective phase shifting elements 1619. Both antenna elements 1616, 1617 are connected through means for routing and transmitting the signal 1620 to combining means 1621 that interconnects the signals from antenna elements 1616, 1617 to the input/output port 1622.

The input/output ports 1615, 1622 of both the two distributed antenna systems are combined through combining means 1623 to form a higher level distributed antenna system. The higher level distributed antenna system depicted in FIG. 16C is interconnect to the RF module through input/output port 1624. In some embodiments, additional phase shifting elements and routing means are inserted between the combiner of each subsystem (combiner 1621 and/or 1624 in this example) and the combiner of the overall distributed system 1624.

Figure 17A:
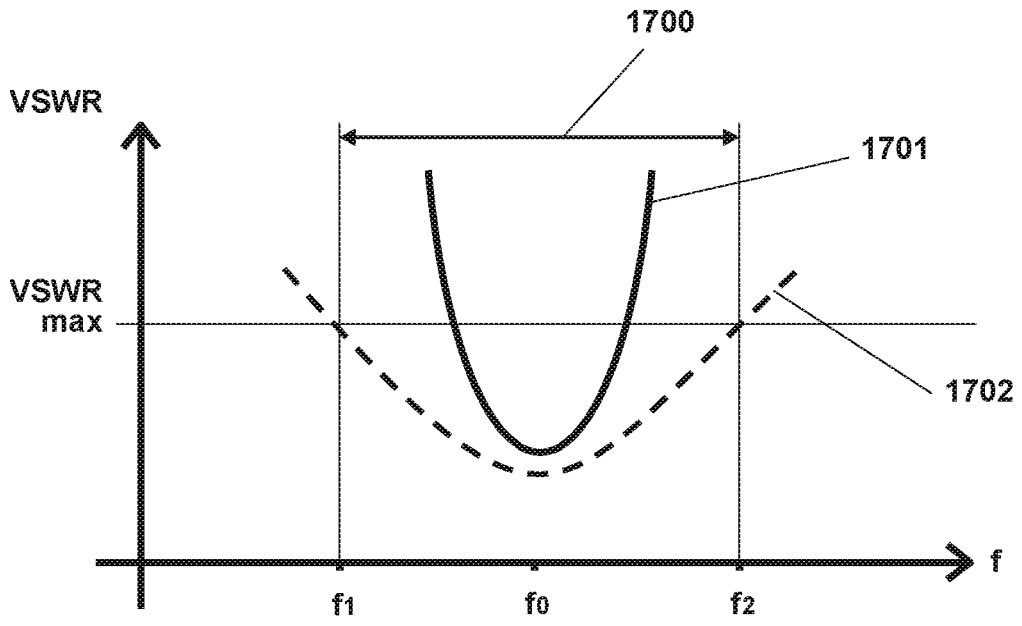
FIGS. 17A-17B—Voltage standing wave ratio graph as a function of frequency of a distributed antenna system according to the present invention and of a prior art antenna array system.

FIG. 17A shows a VSWR (voltage standing wave ratio) graph as a function of frequency of a distributed antenna system according to the present invention. The vertical axis displays VSWR values. VSWR is a measurement of the antenna's impedance and matching to the transmission line, which is related to the fraction of power that is effectively coupled to an antenna element without being reflected by it. As it can be seen, the bandwidth of the individual antenna elements (featuring the VSWR curve 1701) is substantially smaller than the required operating bandwidth 1700. The required operating bandwidth is the bandwidth defined by the upper (f2) and lower (f1) operating frequencies of a certain communication system. It is shown in FIG. 17A that the distributed antenna system according to the invention (featuring the VSWR curve 1702) achieves sufficient bandwidth (corresponding to the width of the portion of the curve lying under the maximum VSWR limit established for the communication system) to completely cover the required operating bandwidth 1700 of a certain communications system, even when the individual elements of the system (featuring the VSWR curve 1701) feature a bandwidth below the required one (cf. the comparatively narrow portion of curve 1701 that lies under the relevant maximum VSWR limit).

In FIG. 17A, the maximum value of the VSWR curve of the antenna element 1701 within the entire operating bandwidth of the antenna system (i.e., the frequency range from f1 to f2) is above the maximum VSWR limit, while the maximum value of the VSWR curve of the antenna system 1702 is below the maximum VSWR limit. Therefore, the maximum value of the VSWR curve of the antenna system 1702 within the entire operating bandwidth of the antenna system is smaller than the maximum value of the VSWR curve of the antenna element 1701 within the entire operating bandwidth. Although, in this example, the VSWR levels are compared, the same conclusion holds for the modulus of the reflection coefficient.

Still referring to FIG. 17A, for a threshold value equal to the maximum VSWR limit, the width of the frequency interval for which the VSWR curve of the antenna system 1702 is smaller than the maximum VSWR limit is larger than the entire operating bandwidth of the antenna system (i.e., the frequency range from f1 to f2), while the width of the frequency interval for which the VSWR curve of the antenna element 1701 is smaller than the maximum VSWR limit is smaller than the entire operating bandwidth of the antenna system. Therefore, for said threshold, the width of the frequency interval for which the VSWR curve of the antenna system 1702 is smaller than said threshold is larger than the width of the frequency interval for which the VSWR curve of the antenna element 1701 is smaller than said threshold.

Figure 17B:
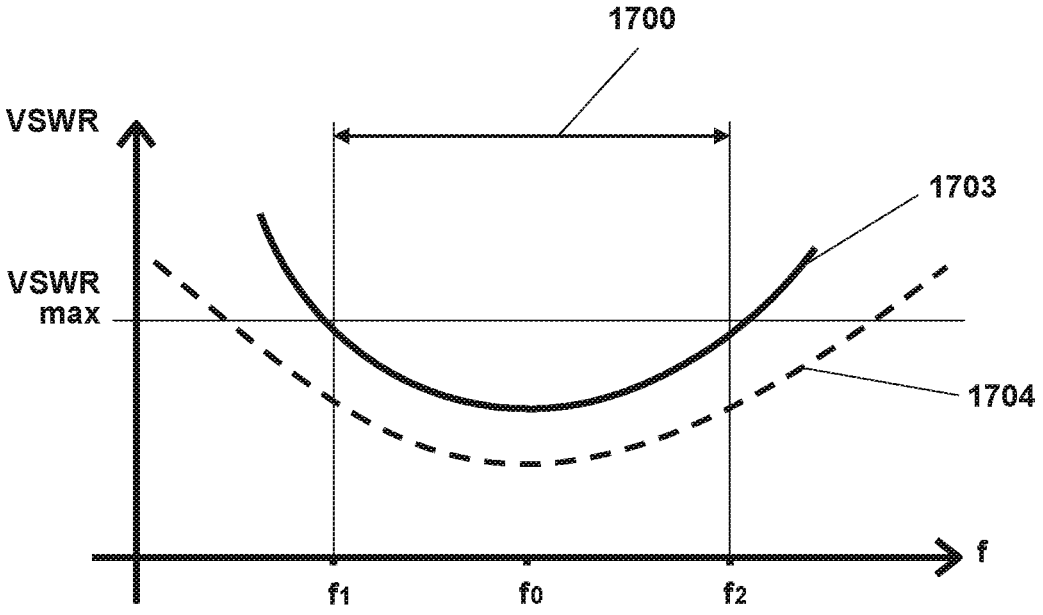

FIG. 17B shows an analogous VSWR graph of an array system as the ones in the prior art. As it can be seen, the bandwidth of the individual antenna elements (corresponding to VSWR curve 1703) is adjusted to match already the required operating bandwidth 1700. It is shown in FIG. 17B that the array system (VSWR curve 1704) features as well a bandwidth that exceeds the required operating bandwidth 1700 of a certain communications system. In an array system, the combination effect is used to improve the VSWR level (as low as possible) of the system, as opposed to achieving the required operating bandwidth.

Space Filling Curves

Figure 2A:
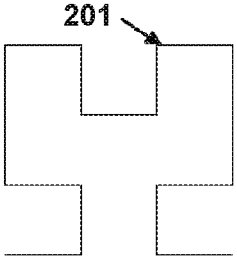
FIGS. 2A-2N—Examples of space filling curves for antenna design.
Figure 2B:
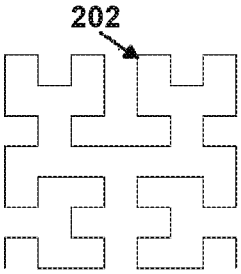
Figure 2C:
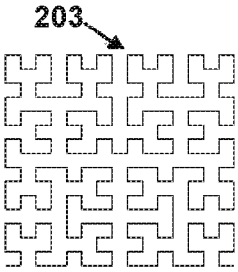
Figure 2D:
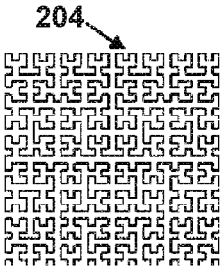
Figure 2E:
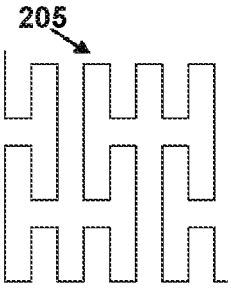
Figure 2F:
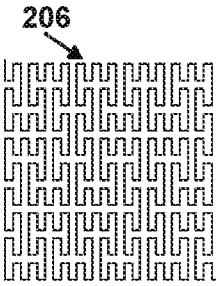
Figure 2G:
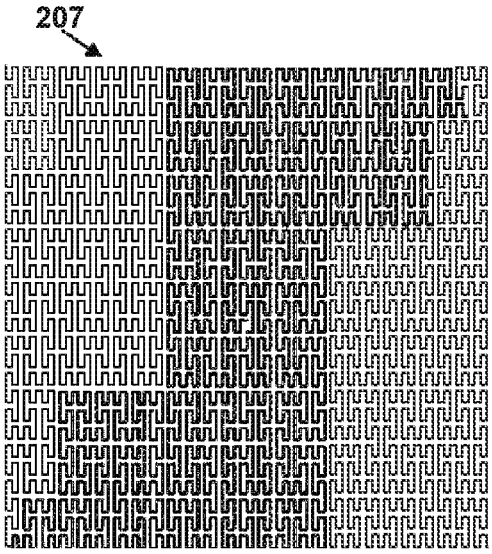
Figure 2H:
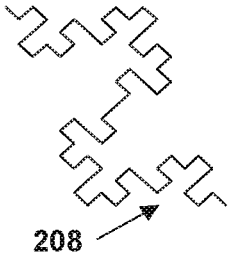
Figure 2I:
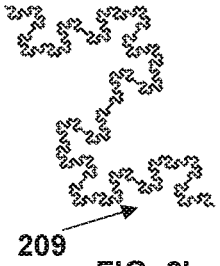
Figure 2J:
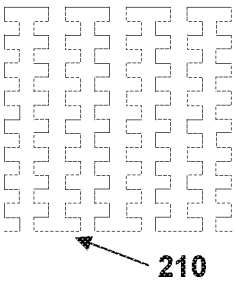
Figure 2K:
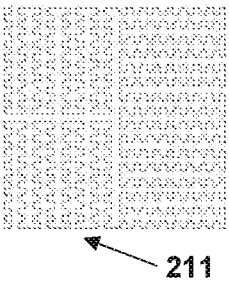
Figure 2L:
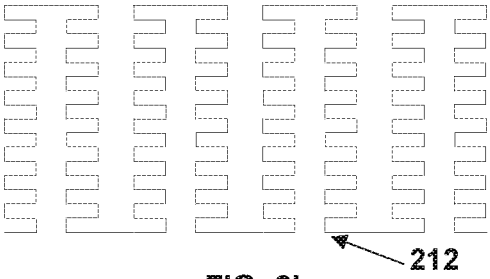
Figure 2M:
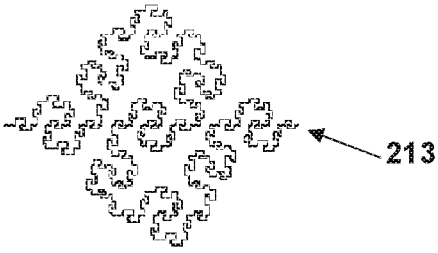
Figure 2N:
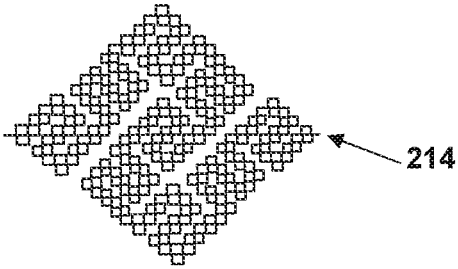

In some examples, one or more of the antenna elements may be miniaturized by shaping at least a portion of the antenna element (e.g., a part of an arm in a dipole or in a monopole, a perimeter of the patch of a patch antenna, the slot in a slot antenna, the loop perimeter in a loop antenna or in a gap-loop antenna, or other portions of the antenna) as a space-filling curve (SFC). Examples of space filling curves (including for instance the Hilbert curve or the Peano curve) are shown in FIGS. 2A-2N (see curves 201, 202, 203, 204, 205, 206, 207, 208, 209, 210, 211, 212, 213, 214). A SFC is a curve that is large in terms of physical length but small in terms of the area in which the curve can be included. Space filling curves fill the surface or volume where they are located in an efficient way while keeping the linear properties of being curves. In general space filling curves may be composed of straight, substantially straight and/or curved segments. More precisely, for the purposes of this patent document, a SFC may be defined as follows: a curve having at least a minimum number of segments that are connected in such a way that each segment forms an angle (or bend) with any adjacent segments, such that no pair of adjacent segments defines a larger straight segment. The bends between adjacent segments increase the degree of convolution of the SFC leading to a curve that is geometrically rich in at least one of edges, angles, corners or discontinuities, when considered at different levels of detail. In some cases, the corners formed by adjacent segments of the SFC may be rounded or smoothed. Possible values for the said minimum number of segments include 5, 6, 7, 8, 10, 12, 14, 16, 18, 20, 25, 30, 35, 40, 45 and 50. In addition, a SFC does not intersect with itself at any point except possibly the initial and final point (that is, the whole curve can be arranged as a closed curve or loop, but none of the lesser parts of the curve form a closed curve or loop).

A space-filling curve can be fitted over a flat surface, a curved surface, or even over a surface that extends in more than one plane, and due to the angles between segments, the physical length of the curve is larger than that of any straight line that can be fitted in the same area (surface) as the space-filling curve. Additionally, to shape the structure of a miniature antenna, the segments of the SFCs should be shorter than at least one fifth of the free-space operating wavelength, and possibly shorter than one tenth of the free-space operating wavelength. Moreover, in some further examples the segments of the SFCs should be shorter than at least one twentieth of the free-space operating wavelength. The space-filling curve should include at least five segments in order to provide some antenna size reduction; however a larger number of segments may be used, such as for instance 10, 15, 20, 25 or more segments. In general, the larger the number of segments and the narrower the angles between them, the smaller the size of the final antenna. An antenna shaped as a SFC is small enough to fit within a radian sphere (e.g., a sphere with a radius equal to the longest free-space operating wavelength of the antenna divided by $2\pi$). However, the antenna features a resonance frequency lower than that of a straight line antenna substantially similar in size.

A SFC may also be defined as a non-periodic curve including a number of connected straight, substantially straight and/or curved segments smaller than a fraction of the longest operating free-space wavelength, where the segments are arranged in such a way that no adjacent and connected segments form another longer straight segment and wherein none of said segments intersect each other.

Alternatively, a SFC can be defined as a non-periodic curve comprising at least a minimum number of bends, wherein the distance between each pair of adjacent bends is shorter than a tenth of the longest free-space operating wavelength. Possible values of said minimum number of bends include 5, 10, 15, 20 and 25. In some examples, the distances between pairs of consecutive bends of the SFC are different for at least two pairs of bends. In some other examples, the radius of curvature of each bend is smaller than a tenth of the longest operating free-space wavelength.

Yet another definition of a SFC is that of a non-periodic curve comprising at least a minimum number of identifiable cascaded sections. Each section of the SFC forms an angle with other adjacent sections, and each section has a diameter smaller than a tenth of the longest free-space operating wavelength. Possible values of said minimum number of identifiable cascaded sections include 5, 10, 15, 20 and 25.

In one example, an antenna geometry forming a space-filling curve may include at least five segments, each of the at least five segments forming an angle with each adjacent segment in the curve, at least three of the segments being shorter than one-tenth of the longest free-space operating wavelength of the antenna. Preferably each angle between adjacent segments is less than 180° and at least two of the angles between adjacent sections are less than 115°, and at least two of the angles are not equal. The example curve fits inside a rectangular area, the longest side of the rectangular area being shorter than one-fifth of the longest free-space operating wavelength of the antenna. Some space-filling curves might approach a self-similar or self-affine curve, while some others would rather become dissimilar, that is, not displaying self-similarity or self-affinity at all (see for instance 210, 211, 212).

Box-Counting Curves

In other examples, one or more of the antenna elements may be miniaturized by shaping at least a portion of the antenna element to have a selected box-counting dimension. For a given geometry lying on a surface, the box-counting dimension is computed as follows. First, a grid with rectangular or substantially squared identical boxes of size L1 is placed over the geometry, such that the grid completely covers the geometry, that is, no part of the curve is out of the grid. The number of boxes N1 that include at least a point of the geometry are then counted. Second, a grid with boxes of size L2 (L2 being smaller than L1) is also placed over the geometry, such that the grid completely covers the geometry, and the number of boxes N2 that include at least a point of the geometry are counted. The box-counting dimension D is then computed as:

$$D = -\frac{\log(N2) - \log(N1)}{\log(L2) - \log(L1)}$$

For the purposes of this document, the box-counting dimension may be computed by placing the first and second grids inside a minimum rectangular area enclosing the conducting trace of the antenna and applying the above algorithm. The first grid in general has n×n boxes and the second grid has 2n×2n boxes matching the first grid. The first grid should be chosen such that the rectangular area is meshed in an array of at least 5×5 boxes or cells, and the second grid should be chosen such that L2=½ L1 and such that the second grid includes at least 10×10 boxes. The minimum rectangular area is an area in which there is not an entire row or column on the perimeter of the grid that does not contain any piece of the curve. Further the minimum rectangular area preferably refers to the smallest possible rectangle that completely encloses the curve or the relevant portion thereof.

Figure 3A:
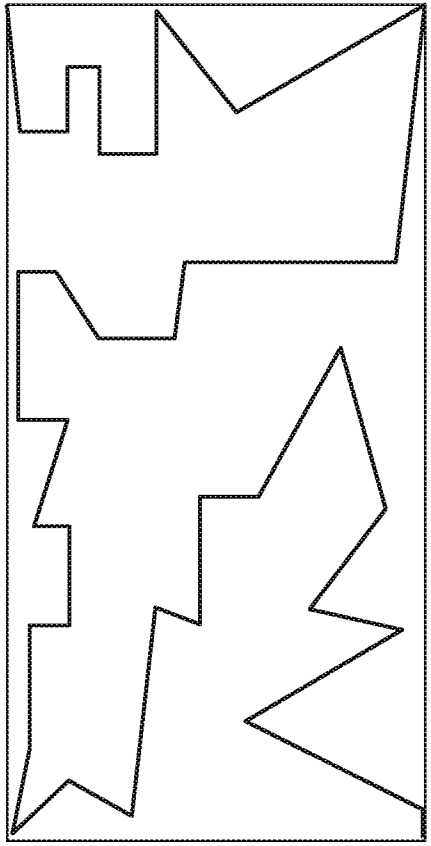
FIGS. 3A-3C—Example of how to calculate the box counting dimension using a grid of rectangular cells to divide the smallest possible rectangle enclosing the curve.
Figure 3B:
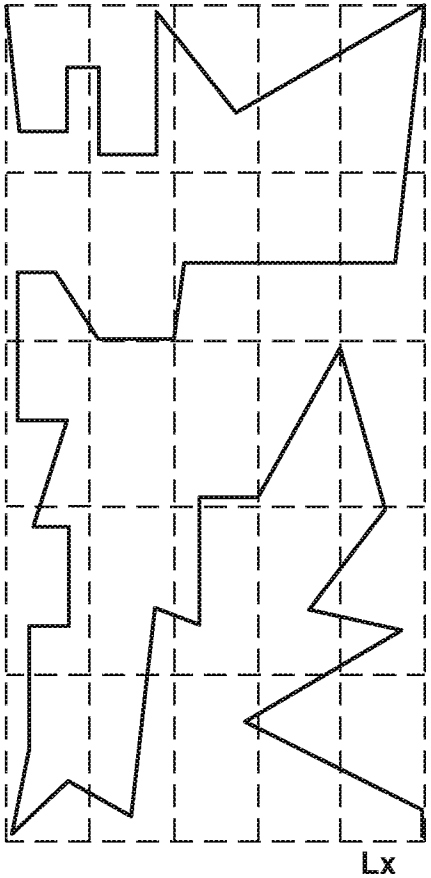
Figure 3C:
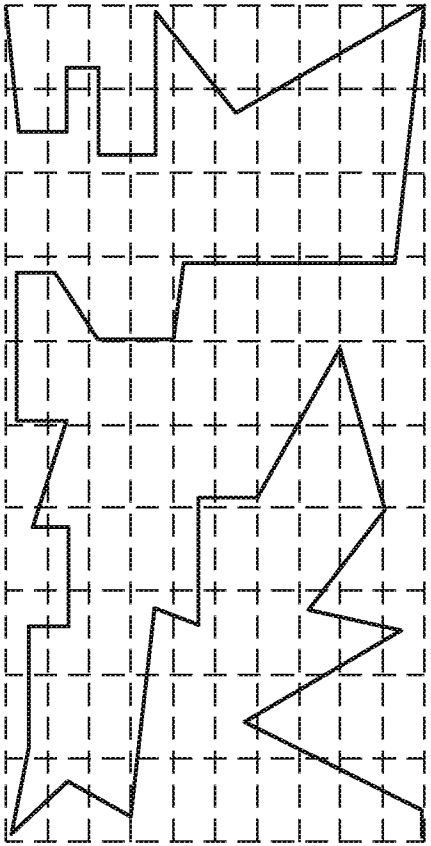

An example of how the relevant grid can be determined is shown in FIGS. 3A-3C. In FIG. 3A a box-counting curve is shown in it smallest possible rectangle that encloses that curve. The rectangle is divided in an n×n (here as an example 5×5) grid of identical rectangular cells, where each side of the cells corresponds to 1/n of the length of the parallel side of the enclosing rectangle. However, the length of any side of the rectangle (e.g., Lx or Ly in FIG. 3B) may be taken for the calculation of D since the boxes of the second grid (see FIG. 3C) have the same reduction factor with respect to the first grid along the sides of the rectangle in both directions (x and y direction) and hence the value of D will be the same no matter whether the shorter (Lx) or the longer (Ly) side of the rectangle is taken into account for the calculation of D. In some rare cases there may be more than one smallest possible rectangle. In this case the smallest possible rectangle giving the smaller value of D is chosen.

Figure 4A:
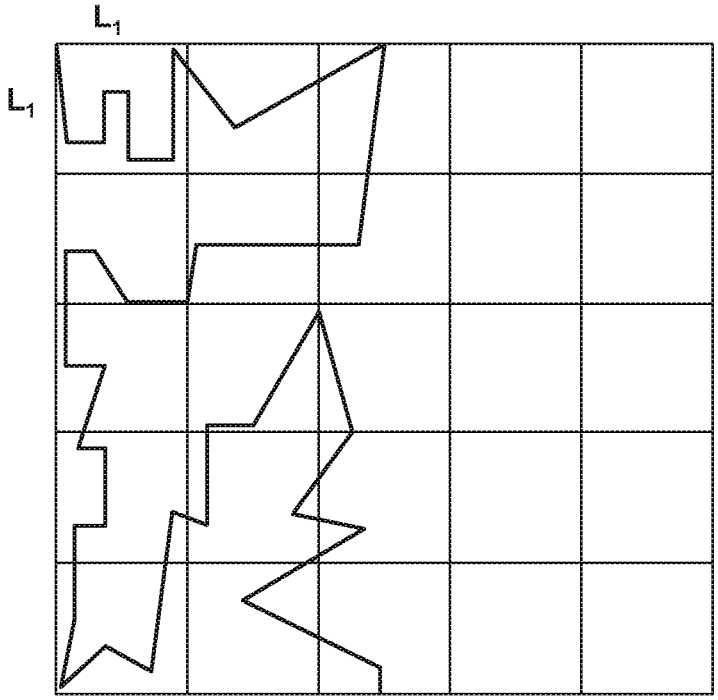
FIG. 4A-4B—Example of how to calculate the box counting dimension using a grid of substantially square cells.
Figure 4B:
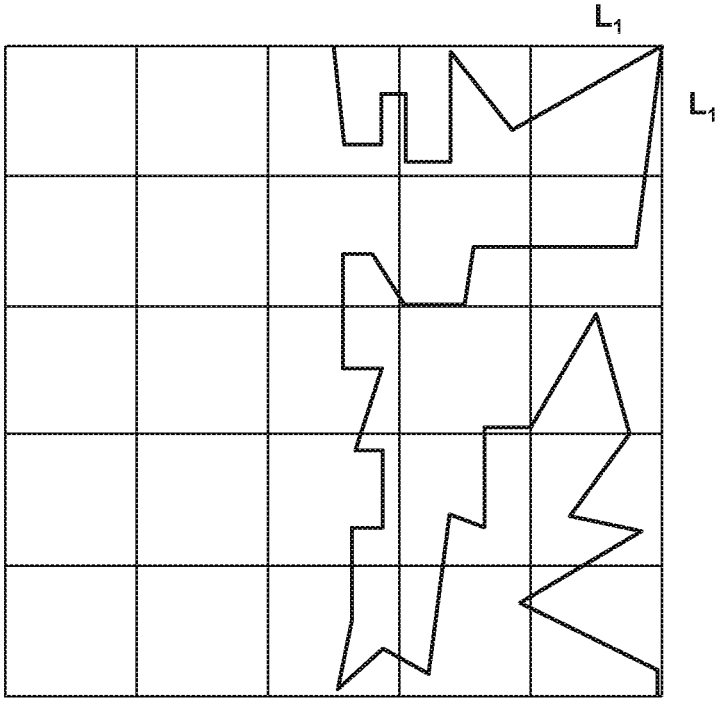

Alternatively the grid may be constructed such that the longer side (see left edge of rectangle in FIG. 3A) of the smallest possible rectangle is divided into n equal parts (see L1 on left edge of grid in FIG. 4A) and the n×n grid of squared boxes has this side in common with the smallest possible rectangle such that it covers the curve or the relevant part of the curve. In FIG. 4A the grid therefore extends to the right of the common side. Here there may be some rows or columns which do not have any part of the curve inside (see the ten boxes on the right hand edge of the grid in FIG. 4A). In FIG. 4B the right edge of the smallest rectangle (see FIG. 3A) is taken to construct the n×n grid of identical square boxes. Hence, there are two longer sides of the rectangular based on which the n×n grid of identical square boxes may be constructed and therefore preferably the grid of the two first grids giving the smaller value of D has to be taken into account.

If the value of D calculated by a first n×n grid of identical rectangular boxes (FIG. 3B) inside of the smallest possible rectangle enclosing the curve and a second 2n×2n grid of identical rectangular boxes (FIG. 3C) inside of the smallest possible rectangle enclosing the curve and the value of D calculated from a first n×n grid of squared identical boxes (see FIG. 4A or FIG. 4B) and a second 2n×2n grid of squared identical boxes where the grid has one side in common with the smallest possible rectangle, differ, then preferably the first and second grid giving the smaller value of D have to be taken into account.

The desired box-counting dimension for the curve may be selected to achieve a desired amount of miniaturization. The box-counting dimension should be larger than 1.1 in order to achieve some antenna size reduction. If a larger degree of miniaturization is desired, then a larger box-counting dimension may be selected, such as a box-counting dimension ranging from 1.5 to 2 for surface structures, while ranging up to 3 for volumetric geometries. For the purposes of this patent document, curves in which at least a portion of the geometry of the curve or the entire curve has a box-counting dimension larger than 1.1 may be referred to as box-counting curves.

Alternatively a curve may be considered as a box counting curve if there exists a first n×n grid of identical square or identical rectangular boxes and a second 2n×2n grid of identical square or identical rectangular boxes where the value of D is larger than 1.1, 1.15, 1.2, 1.25, 1.3, 1.35, 1.4, 1.5, 1.6, 1.7, 1.8, 1.9, 2.0, 2.1, 2.2, 2.3, 2.4, 2.5, 2.6, 2.7, 2.8, or 2.9.

In any case, the value of n for the first grid should not be more than 5, 7, 10, 15, 20, 25, 30, 40 or 50.

For very small antennas, for example antennas that fit within a rectangle having a maximum size equal to one-twentieth the longest free-space operating wavelength of the antenna, the box-counting dimension may be computed using a finer grid. In such a case, the first grid may include a mesh of 10×10 equal cells, and the second grid may include a mesh of 20×20 equal cells. The grid-dimension (D) may then be calculated using the above equation.

In general, for a given resonant frequency of the antenna, the larger the box-counting dimension, the higher the degree of miniaturization that will be achieved by the antenna.

One way to enhance the miniaturization capabilities of the antenna (that is, reducing size while maximizing bandwidth, efficiency and gain) is to arrange the several segments of the curve of the antenna pattern in such a way that the curve intersects at least one point of at least 14 boxes of the first grid with 5×5 boxes or cells enclosing the curve. If a higher degree of miniaturization is desired, then the curve may be arranged to cross at least one of the boxes twice within the 5×5 grid, that is, the curve may include two non-adjacent portions inside at least one of the cells or boxes of the grid. The relevant grid here may be any of the above mentioned constructed grids or may be any grid. That means if any 5×5 grid exists with the curve crossing at least 14 boxes or crossing one or more boxes twice the curve may be said to be a box counting curve.

Figure 1A:
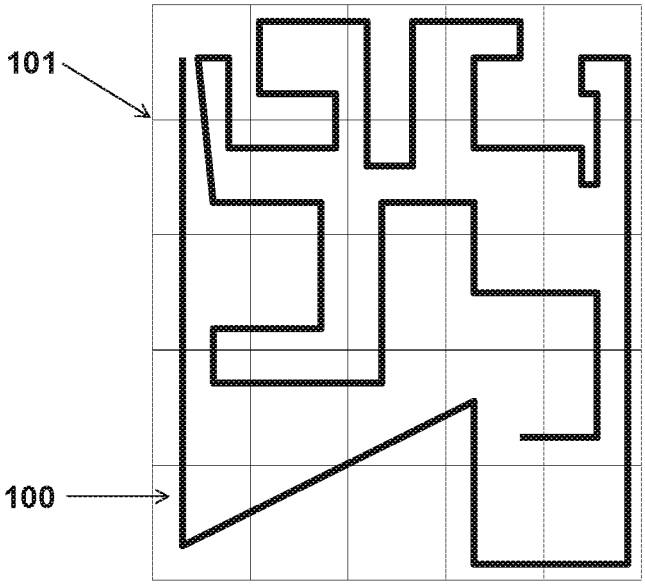
FIGS. 1A-1B—Example of how to calculate the box counting dimension.
Figure 1B:
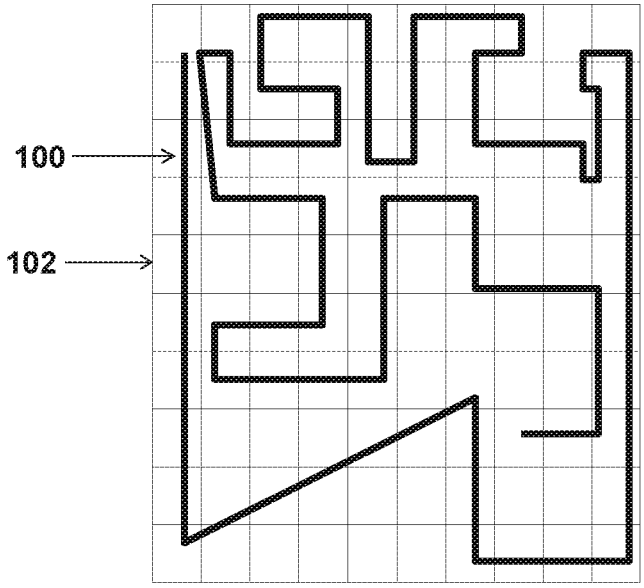

FIGS. 1A-1B illustrate an example of how the box-counting dimension of a curve (100) is calculated. The example curve (100) is placed under a 5×5 grid (101) (FIG. 1A) and under a 10×10 grid (102) (FIG. 1B). As illustrated, the curve (100) touches N1=25 boxes in the 5×5 grid (101) and touches N2=78 boxes in the 10×10 grid (102). In this case, the size of the boxes in the 5×5 grid 2 is twice the size of the boxes in the 10×10 grid (102). By applying the above equation, the box-counting dimension of the example curve (100) may be calculated as D=1.6415. In addition, further miniaturization is achieved in this example because the curve (100) crosses more than 14 of the 25 boxes in grid (101), and also crosses at least one box twice, that is, at least one box contains two non-adjacent segments of the curve. More specifically, the curve (100) in the illustrated example crosses twice in 13 boxes out of the 25 boxes.

The terms explained above can be also applied to curves that extend in three dimensions. If the extension in the third dimension is rather small the curve will fit into an n×n×1 arrangement of 3D-boxes (cubes of size L1×L1×L1) in a plane. Then the calculations can be performed as described above. Here the second grid will be a 2n×2n×1 grid of cuboids of size L2×L2×L1.

If the extension in the third dimension is larger an n×n×n first grid and a 2n×2n×2n second grid will be taken into account. The construction principles for the relevant grids as explained above for two dimensions apply equally in three dimensions.

Grid Dimension Curves

In yet other examples, one or more of the antenna elements may be miniaturized by shaping at least a portion of the antenna element to include a grid dimension curve. For a given geometry lying on a planar or curved surface, the grid dimension of the curve may be calculated as follows. First, a grid with substantially square identical cells of size L1 is placed over the geometry of the curve, such that the grid completely covers the geometry, and the number of cells N1 that include at least a point of the geometry are counted. Second, a grid with cells of size L2 (L2 being smaller than L1) is also placed over the geometry, such that the grid completely covers the geometry, and the number of cells N2 that include at least a point of the geometry are counted again. The grid dimension D is then computed as:

$$D = -\frac{\log(N2) - \log(N1)}{\log(L2) - \log(L1)}$$

For the purposes of this document, the grid dimension may be calculated by placing the first and second grids inside the minimum rectangular area enclosing the curve of the antenna and applying the above algorithm. The minimum rectangular area is an area in which there is not an entire row or column on the perimeter of the grid that does not contain any piece of the curve.

The first grid may, for example, be chosen such that the rectangular area is meshed in an array of at least 25 substantially equal preferably square cells. The second grid may, for example, be chosen such that each cell of the first grid is divided in 4 equal cells, such that the size of the new cells is L2=½ L1, and the second grid includes at least 100 cells.

Depending on the size and position of the squares of the grid the number of squares of the smallest rectangular may vary. A preferred value of the number of squares is the lowest number above or equal to the lower limit of 25 identical squares that arranged in a rectangular or square grid cover the curve or the relevant portion of the curve. This defines the size of the squares. Other preferred lower limits here are 50, 100, 200, 250, 300, 400 or 500. The grid corresponding to that number in general will be positioned such that the curve touches the minimum rectangular at two opposite sides. The grid may generally still be shifted with respect to the curve in a direction parallel to the two sides that touch the curve. Of such different grids the one with the lowest value of D is preferred. Also the grid whose minimum rectangular is touched by the curve at three sides (see as an example FIGS. 4A-4B) is preferred. The one that gives the lower value of D is preferred here.

The desired grid dimension for the curve may be selected to achieve a desired amount of miniaturization. The grid dimension should be larger than 1 in order to achieve some antenna size reduction. If a larger degree of miniaturization is desired, then a larger grid dimension may be selected, such as a grid dimension ranging from 1.5-3 (e.g., in case of volumetric structures). In some examples, a curve having a grid dimension of about 2 may be desired. For the purposes of this patent document, a curve or a curve where at least a portion of that curve is having a grid dimension larger than 1 may be referred to as a grid dimension curve. In some cases, a grid dimension curve will feature a grid dimension D larger than 1.1, 1.15, 1.2, 1.25, 1.3, 1.35, 1.4, 1.5, 1.6, 1.7, 1.8, 1.9, 2.0, 2.1, 2.2, 2.3, 2.4, 2.5, 2.6, 2.7, 2.8, or 2.9.

In general, for a given resonant frequency of the antenna, the larger the grid dimension the higher the degree of miniaturization that will be achieved by the antenna.

One example way of enhancing the miniaturization capabilities of the antenna is to arrange the several segments of the curve of the antenna pattern in such a way that the curve intersects at least one point of at least 50% of the cells of the first grid with at least 25 cells (preferably squares) enclosing the curve. In another example, a high degree of miniaturization may be achieved by arranging the antenna such that the curve crosses at least one of the cells twice within the 25 cell grid (of preferably squares), that is, the curve includes two non-adjacent portions inside at least one of the cells or cells of the grid. In general the grid may have only a line of cells but may also have at least 2 or 3 or 4 columns or rows of cells.

Figure 5:
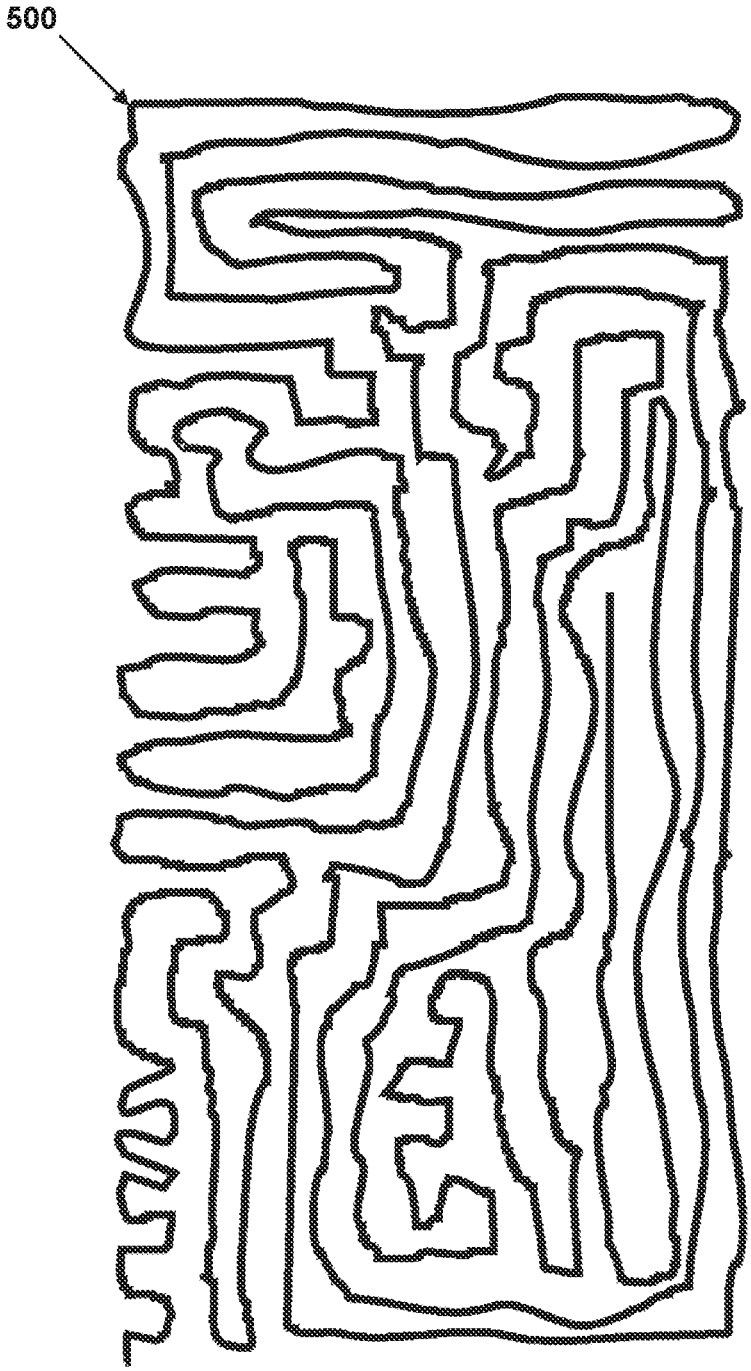
FIG. 5—Example of a curve featuring a grid-dimension larger than 1, referred to herein as a grid-dimension curve.
Figure 6:
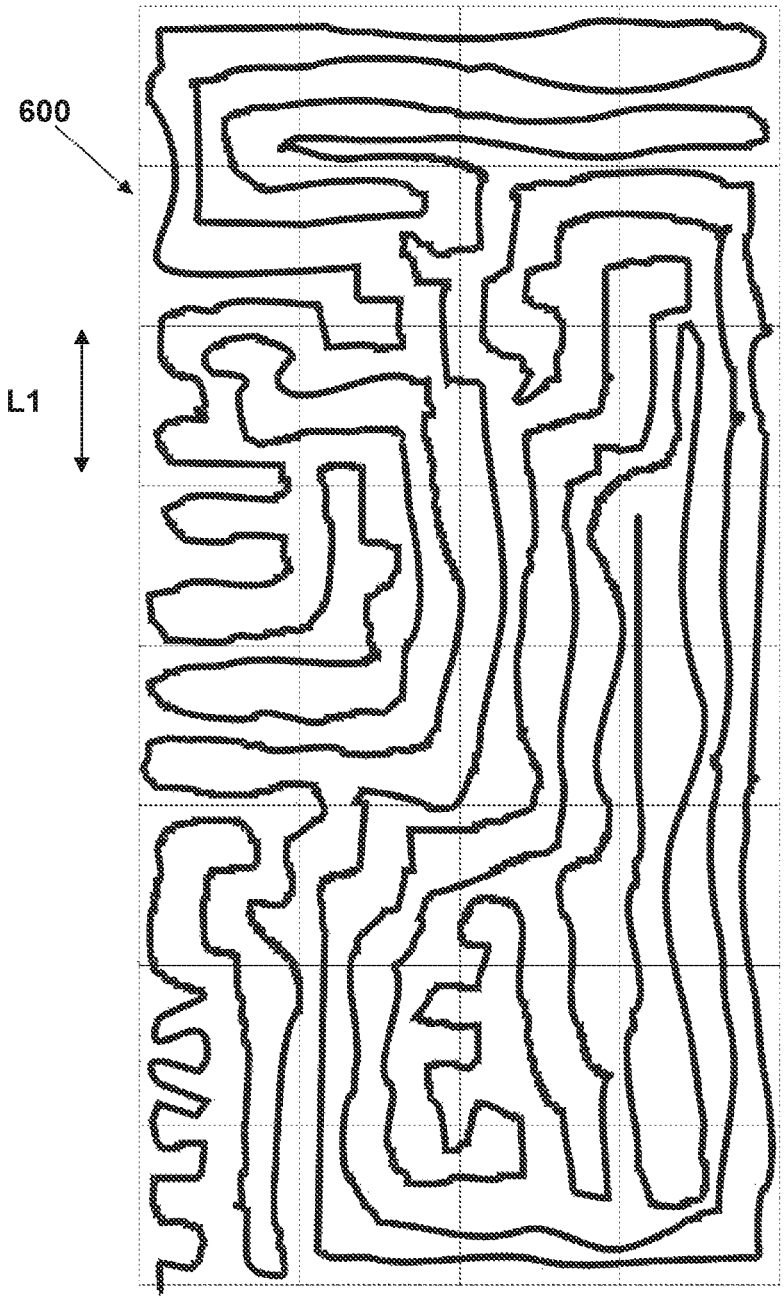
FIG. 6—The curve of FIG. 5 in the 32-cell grid, wherein the curve crosses all 32 cells and therefore N1=32.
Figure 7:
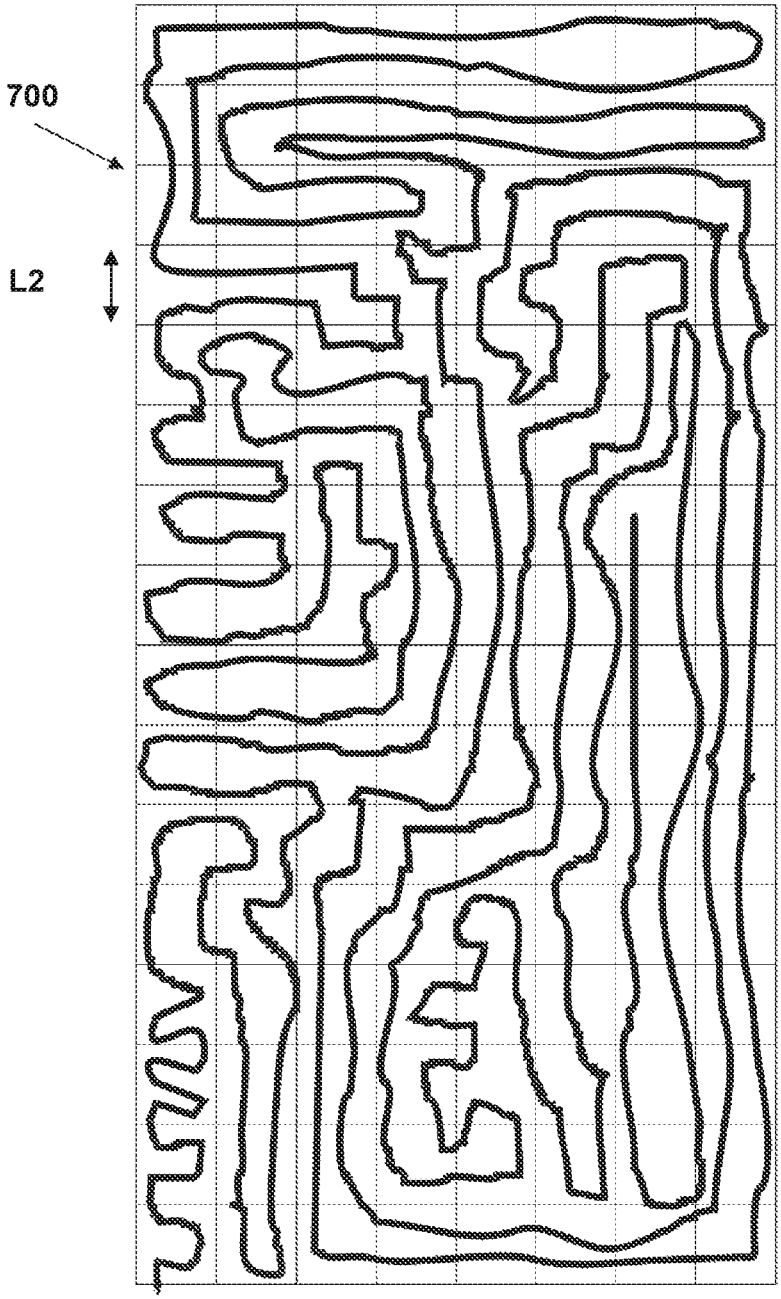
FIG. 7—The curve of FIG. 5 in a 128-cell grid, wherein the curve crosses all 128 cells and therefore N2=128.

FIG. 5 shows an example two-dimensional antenna (500) forming a grid dimension curve with a grid dimension of approximately two. FIG. 6 shows the antenna of FIG. 5 enclosed in a first grid (600) having thirty-two (32) square cells, each with a length L1. FIG. 7 shows the same antenna enclosed in a second grid (700) having one hundred twenty-eight (128) square cells, each with a length L2. The length (L1) of each square cell in the first grid is twice the length (L2) of each square cell in the second grid (L1=2×L2). An examination of FIG. 6 and FIG. 7 reveals that at least a portion of the antenna is enclosed within every square cell in both the first and second grids. Therefore, the value of N1 in the above grid dimension (Dg) equation is thirty-two (32) (i.e., the total number of cells in the first grid), and the value of N2 is one hundred twenty-eight (128) (i.e., the total number of cells in the second grid). Using the above equation, the grid dimension of the antenna may be calculated as follows:

$$D_g = -\frac{\log(128) - \log(32)}{\log(2 \times L1) - \mathrm{Log}(L1)} = 2$$

For a more accurate calculation of the grid dimension, the number of square cells may be increased up to a maximum amount. The maximum number of cells in a grid is dependent upon the resolution of the curve. As the number of cells approaches the maximum, the grid dimension calculation becomes more accurate. If a grid having more than the maximum number of cells is selected, however, then the accuracy of the grid dimension calculation begins to decrease. Typically, the maximum number of cells in a grid is one thousand (1000).

Figure 8:
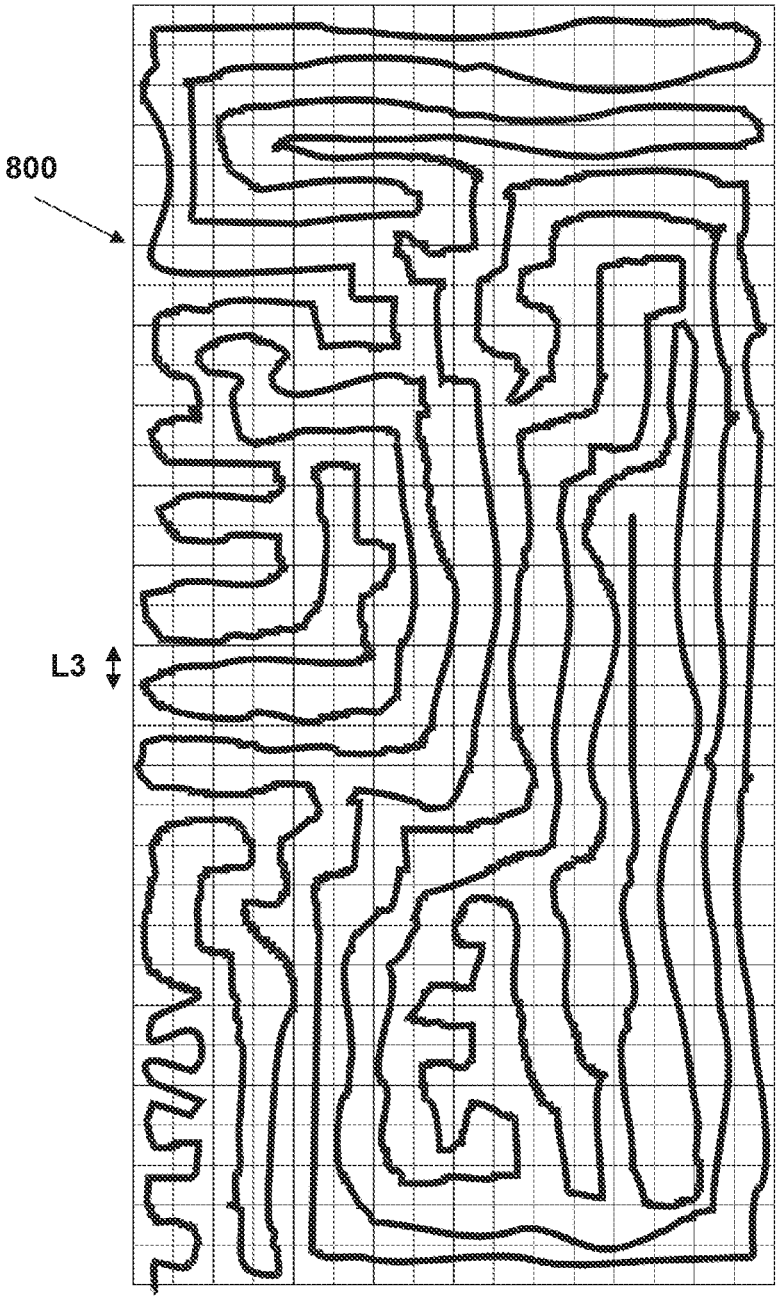
FIG. 8—The curve of FIG. 5 in a 512-cell grid, wherein the curve crosses at least one point of 509 cells.

For example, FIG. 8 shows the same antenna as of FIG. 5 enclosed in a third grid (800) with five hundred twelve (512) square cells, each having a length L3. The length (L3) of the cells in the third grid is one half the length (L2) of the cells in the second grid, shown in FIG. 7. As noted above, a portion of the antenna is enclosed within every square cell in the second grid, thus the value of N for the second grid is one hundred twenty-eight (128). An examination of FIG. 8, however, reveals that the antenna is enclosed within only five hundred nine (509) of the five hundred twelve (512) cells of the third grid. Therefore, the value of N for the third grid is five hundred nine (509). Using FIG. 7 and FIG. 8, a more accurate value for the grid dimension (Dg) of the antenna may be calculated as follows:

$$D_g = -\frac{\log(509) - \log(128)}{\log(2 \times L2) - \mathrm{Log}(L2)} \approx 1.9915$$

It should be understood that a grid-dimension curve does not need to include any straight segments. Also, some grid-dimension curves might approach a self-similar or self-affine curves, while some others would rather become dissimilar, that is, not displaying self-similarity or self-affinity at all (see for instance FIG. 5).

The terms explained above can be also applied to curves that extend in three dimensions. If the extension in the third dimension is rather small the curve will fit into an arrangement of 3D-boxes (cubes) in a plane. Then the calculations can be performed as described above. Here the second grid will be composed in the same plane of boxes with the size L2×L2×L1.

If the extension in the third dimension is larger an m×n×o first grid and a 2m×2n×2o second grid will be taken into account. The construction principles for the relevant grids as explained above for two dimensions apply equally in three dimensions. Here the minimum number of cells preferably is 25, 50, 100, 125, 250, 400, 500, 1000, 1500, 2000, 3000, 4000 or 5000.

Multilevel Structures

In another example, at least a portion of one or more of the antenna elements may be coupled, either through direct contact or electromagnetic coupling, to a conducting surface, such as a conducting polygonal or multilevel surface. Further, the antenna element may include the shape of a multilevel structure. A multilevel structure is formed by gathering several identifiable geometrical elements such as polygons or polyhedrons of the same type or of different type (e.g., triangles, parallelepipeds, pentagons, hexagons, circles or ellipses as special limiting cases of a polygon with a large number of sides, as well as tetrahedral, hexahedra, prisms, dodecahedra, etc.) and coupling these structures to each other electromagnetically, whether by proximity or by direct contact between elements.

At least two of the elements may have a different size. However, also all elements may have the same or approximately the same size. The size of elements of a different type may be compared by comparing their largest diameter. The polygons or polyhedrons of a multilevel structure may comprise straight, flat and/or curved peripheral portions. Some polygons or polyhedrons may have perimeter portions comprising portions of circles and/or ellipses.

The majority of the component elements of a multilevel structure have more than 50% of their perimeter (for polygons) or of their surface (for polyhedrons) not in contact with any of the other elements of the structure. In some examples, the said majority of component elements would comprise at least the 50%, 55%, 60%, 65%, 70% or 75% of the geometric elements of the multilevel structure. Thus, the component elements of a multilevel structure may typically be identified and distinguished, presenting at least two levels of detail: that of the overall structure and that of the polygon or polyhedron elements which form it. Additionally, several multilevel structures may be grouped and coupled electromagnetically to each other to form higher level structures. In a single multilevel structure, all of the component elements are polygons with the same number of sides or are polyhedrons with the same number of faces. However, this characteristic may not be true if several multilevel structures of different natures are grouped and electromagnetically coupled to form meta-structures of a higher level.

A multilevel antenna includes at least two levels of detail in the body of the antenna: that of the overall structure and that of the majority of the elements (polygons or polyhedrons) which make it up. This may be achieved by ensuring that the area of contact or intersection (if it exists) between the majority of the elements forming the antenna is only a fraction of the perimeter or surrounding area of said polygons or polyhedrons. The elements (polygons or polyhedrons) are identifiable by their exposed edges and, when there is contact or overlapping between elements, by the extension of their exposed edges (such as for example through projection) into said region of contact or overlapping.

One example property of a multilevel antenna is that the radioelectric behavior of the antenna can be similar in more than one frequency band. Antenna input parameters (e.g., impedance) and radiation patterns remain substantially similar for several frequency bands (i.e., the antenna has the same level of impedance matching or standing wave relationship in each different band), and often the antenna presents almost identical radiation diagrams at different frequencies. Such a property allows the antenna to operate simultaneously in several frequencies, thereby being able to be shared by several communication devices. The number of frequency bands is proportional to the number of scales or sizes of the polygonal elements or similar sets in which they are grouped contained in the geometry of the main radiating element.

In a multilevel antenna operating in several frequency bands, different subsets of geometrical elements of the multilevel structure are associated with the different frequency bands of the antenna. In some cases for example, the overall structure can be responsible for one frequency, and different subsets of geometrical elements within the structure be responsible for other frequency bands. In some examples, a first subset of geometrical elements can comprise at least some of the geometrical elements of a second subset, while in other cases the first subset may comprise a majority of the geometrical elements of the second subset (i.e., the second subset is substantially within the first subset).

In addition to their multiband behavior, multilevel structure antennae may have a smaller than usual size as compared to other antennae of a simpler structure (such as those consisting of a single polygon or polyhedron) operating at the same frequency. The empty spaces defined within the multilevel structure provide a long and winding path for the electrical currents, making the antenna resonate at a lower frequency than that of a radiating structure not including said empty spaces. Additionally, the edge-rich and discontinuity-rich structure of a multilevel antenna may enhance the radiation process, relatively increasing the radiation resistance of the antenna and/or reducing the quality factor Q (i.e., increasing its bandwidth).

A multilevel antenna structure may be used in many antenna configurations, such as dipoles, monopoles, patch or microstrip antennae, coplanar antennae, reflector antennae, aperture antennae, antenna arrays, or other antenna configurations. In addition, multilevel antenna structures may be formed using many manufacturing techniques, such as printing on a dielectric substrate by photolithography (printed circuit technique); dieing on metal plate, repulsion on dielectric, or others.

What is claimed is:

1. A wireless device comprising:

an antenna system included within the wireless device and configured to operate in at least one operating frequency region having a first required operating frequency bandwidth, the antenna system comprising:

a ground plane layer contained in a printed circuit board having a shorter edge; and at least two antenna elements connected to a common input/output port, each of the at least two antenna elements comprising one driven point, and having a resonant frequency measured at the driven point above a highest frequency of the at least one operating frequency region, wherein the at least two antenna elements are not arranged as a directive antenna array that provides a directive radiation pattern, wherein:

one or more of the at least two antenna elements comprises a surface mount device (SMD) element;

at least one antenna element comprises a conductive trace upon one or more of the surfaces of a dielectric substrate featuring a relative dielectric permittivity greater than 2;

the ground plane layer is cut out to leave a clearance for placing the at least two antenna elements; and at least one of the at least two antenna elements is placed near the shorter edge of the printed circuit board.

2. The wireless device according to claim 1, wherein the antenna system operates in at least one operating frequency region comprised in a frequency range between 400 MHz and 6 GHz.

3. The wireless device according to claim 1, wherein a first operating frequency band comprises a 824-960 MHz frequency range, and a second operating frequency band comprises a 1710-2500 MHz frequency range.

4. The wireless device according to claim 1, wherein the at least two antenna elements feature a footprint on the printed circuit board of the wireless device smaller than 50% of the footprint of a single-element antenna system containing a rectangular PIFA antenna element operating at the same lowest frequency band.

5. The wireless device according to claim 4, wherein the footprint of the at least two antenna elements on the printed circuit board of the wireless device is smaller than 30% of the footprint of a single-element antenna system containing a rectangular PIFA antenna element operating at the same lowest frequency band.

6. The wireless device according to claim 4, wherein the footprint of the at least two antenna elements on the printed circuit board of the wireless device is smaller than 15% of the footprint of a single-element antenna system containing a rectangular PIFA antenna element operating at the same lowest frequency band.

7. The wireless device according to claim 1, wherein the frequency bandwidth of each of a first antenna element and a second antenna element at respective driven points is smaller than a first required operating frequency bandwidth for the antenna system.

8. The wireless device according to claim 1, wherein at least one of the at least two antenna elements comprises a grid dimension curve with a grid dimension D greater than 1.1.

9. The wireless device according to claim 1, wherein at least one of the at least two antenna elements features a partial footprint on the ground plane layer.

10. The wireless device according to claim 1, wherein at least one of the at least two antenna elements is placed entirely over the ground plane layer.

11. The wireless device according to claim 1, wherein at least one of the at least two antenna elements is placed entirely over the ground plane clearance.

12. The wireless device according to claim 1, wherein a first resonant frequency of a first antenna element is at least 5% higher than a second resonant frequency of a second antenna element, the resonant frequencies being measured at respective driven points.

13. The wireless device according to claim 1, wherein a first resonant frequency of a first antenna element is less than 1% higher than a second resonant frequency of a second antenna element, the resonant frequencies being measured at respective driven points.

14. The wireless device according to claim 1, wherein a first resonant frequency of a first antenna element is more than 1% but less than 5% higher than a second resonant frequency of a second antenna element, the resonant frequencies being measured at respective driven points.

15. A wireless device comprising:

an antenna system included within the wireless device and configured to operate in at least one operating frequency region having a first required operating frequency bandwidth, the antenna system comprising:

a ground plane layer contained in a printed circuit board having a shorter edge; and at least two antenna elements connected to a common input/output port, each of the at least two antenna elements comprising one driven point, and having a resonant frequency measured at the driven point above a highest frequency of the at least one operating frequency region, wherein the at least two antenna elements are not arranged as a directive antenna array that provides a directive radiation pattern, wherein:

one or more of the at least two antenna elements comprises a surface mount device (SMD) element;

at least one antenna element comprises a conductive trace upon one or more of the surfaces of a dielectric substrate featuring a relative dielectric permittivity higher than 2;

the ground plane layer is cut out to leave a clearance for placing the antenna elements, which feature a footprint of a selected percentage over the ground plane;

at least one of the at least two antenna elements is placed near the shorter edge of the printed circuit board;

the at least two antenna elements feature a footprint on the printed circuit board of the wireless device smaller than 50% of the footprint of a single-element antenna system containing a rectangular PIFA antenna element operating at the same lowest frequency band; and the frequency bandwidth of each of a first and a second antenna elements at respective driven points is smaller than a first required operating frequency bandwidth for the antenna system.

16. The wireless device according to claim 15, wherein at least one of the at least two antenna elements is placed entirely over the ground plane layer.

17. The wireless device according to claim 15, wherein at least one of the at least two antenna elements is placed entirely over the ground plane clearance.

18. The wireless device according to claim 15, wherein the antenna system operates in at least one operating frequency region comprised in a frequency range between 400 MHz and 6 GHz.

19. The wireless device according to claim 15, wherein at least one antenna element comprises a grid dimension curve with a grid dimension D greater than 1.1.

* * * * *